US009131821B2

(12) United States Patent
Powell et al.

(10) Patent No.: US 9,131,821 B2
(45) Date of Patent: Sep. 15, 2015

(54) HAND UTILITY INTERFACE

(76) Inventors: Michael Charlton Powell, Marlow (GB); Leslie James Stokes, Marlow (GB); Rudolf Kautz, Siegburg (DE)

( * ) Notice: Subject to any disclaimer, the term of this patent is extended or adjusted under 35 U.S.C. 154(b) by 1424 days.

(21) Appl. No.: 12/307,700

(22) PCT Filed: Jul. 6, 2007

(86) PCT No.: PCT/GB2007/002528

§ 371 (c)(1),
(2), (4) Date: Mar. 31, 2009

(87) PCT Pub. No.: WO2008/003979

PCT Pub. Date: Jan. 10, 2008

(65) Prior Publication Data

US 2009/0207052 A1 Aug. 20, 2009

(30) Foreign Application Priority Data

Jul. 6, 2006 (GB) ..... 0613416.7
Jan. 16, 2007 (GB) ..... 0700782.6

(51) Int. Cl.
*A47L 13/18* (2006.01)
*A47L 13/16* (2006.01)
*B24D 15/04* (2006.01)

(52) U.S. Cl.
CPC ..... *A47L 13/16* (2013.01); *A47L 13/18* (2013.01); *B24D 15/045* (2013.01)

(58) Field of Classification Search
CPC ..... A47L 13/18; B24D 15/045
USPC ..... 15/227, 244.1
See application file for complete search history.

(56) References Cited

U.S. PATENT DOCUMENTS

| | | | | |
|---|---|---|---|---|
| 1,528,026 | A | 3/1925 | Pease | |
| 1,943,647 | A | 1/1934 | Weller | |
| 2,223,204 | A | 11/1940 | Carmichael | |
| 2,256,098 | A | 9/1941 | Maudlin | |
| 2,505,409 | A | 3/1950 | Kirchner | |
| 2,695,999 | A | 12/1954 | Arnold | |
| 4,516,774 | A | 5/1985 | Nankivell | |
| 4,831,681 | A | 5/1989 | Puder | |
| 4,948,078 | A | 8/1990 | Dumenigo | |
| 5,148,951 | A | 9/1992 | Moure et al. | |
| 5,312,197 | A * | 5/1994 | Abramson | 401/6 |
| 5,441,355 | A | 8/1995 | Moore | |

(Continued)

FOREIGN PATENT DOCUMENTS

| | | | |
|---|---|---|---|
| FR | 1032293 | A | 6/1953 |
| GB | 698315 | A | 10/1953 |
| WO | 9418092 | A1 | 8/1994 |
| WO | 9531923 | A1 | 11/1995 |
| WO | 0069322 | A2 | 11/2000 |
| WO | WO 02/087406 | * | 11/2002 |
| WO | WO 2004/098365 | * | 11/2004 |

*Primary Examiner* — Randall Chin
(74) *Attorney, Agent, or Firm* — Hultquist, PLLC; Steven J. Hultquist; Mary B. Grant

(57) ABSTRACT

A hand utility interface (1) as illustrated in figure (1) has a medially symmetric body providing two lateral finger channels (2*a*) and two medial finger channels (2*b*) extending from a palm part (8) whereby it can be used by either left or right hand. The interface (1) is fabricated from a thin self supporting resilient membrane so that when the fingers of a hand "H" are pressed down into the finger channels (2*a*, 2*b*) the interface gently grips the fingers thereby attaching itself to the hand for use. The interface is sufficiently flexible to reflect the flexure of the fingers of the hand "H". The structure of the interface is such that extension and spreading of the fingers effects single handed discarding of the interface.

18 Claims, 27 Drawing Sheets

(56) References Cited

U.S. PATENT DOCUMENTS

| | | | |
|---|---|---|---|
| 5,718,016 | A | 2/1998 | Sung |
| 5,878,436 | A | 3/1999 | Jones |
| 6,108,817 | A | 8/2000 | Kostelac |
| 6,305,047 | B1 | 10/2001 | Armaly et al. |
| 6,482,168 | B1 | 11/2002 | Betcher |
| 6,540,118 | B1 | 4/2003 | Marciano |
| 2001/0047534 | A1 | 12/2001 | Sandusky |
| 2004/0148675 | A1 | 8/2004 | Powell |
| 2007/0174998 | A1 | 8/2007 | Powell et al. |
| 2008/0276395 | A1 | 11/2008 | Powell et al. |

* cited by examiner

HAND UTILITY INTERFACE

CROSS-REFERENCE TO RELATED APPLICATIONS

This application is a U.S. national phase under the provisions of 35 USC §371 of International Patent Application No. PCT/GB07/02528 filed Jul. 6, 2007, which in turn claims priority of United Kingdom Patent Application No. 0613416.7 filed Jul. 6, 2006 and United Kingdom Patent Application No. 0700782.6 filed Jan. 16, 2007. The disclosures of such international application and priority applications are hereby incorporated herein by reference in their respective entireties, for all purposes.

TECHNICAL FIELD

The present invention relates to a hand utility interface which can grip the hand of a user.

PRIOR ART

The closest known prior art is represented by the applicant's published International application identified here as WO 2006/000762 and WO 2004/098365. Each of these disclosures concerns a hand utility interface fabricated from a block foam structure. While these hand utility interfaces have excellent performance, the fabrication from a block of foam presents certain technical limitations which the present invention seeks to alleviate. In particular the fabrication of a hand utility interface at minimal cost, which is very light, and may provide a waterproof and chemical barrier between the users hand and the task; which can be made very flexible and resilient, and in which the flexibility and resilience can be adjusted to a range of applications; which can take a range of attractive textures and appearances and which delivers protection for the hand, fingers and nails from knocks and stubbing of the finger tips.

STATEMENT OF INVENTION

Accordingly the present invention provides a hand utility interface comprising finger channels each channel sized and shaped to receive one finger of the users hand, wherein the users hand is releasably gripped by the hand utility interface when the fingers of the hand are pressed through an open top of the channel characterised in that;

the hand utility interface is fabricated from a self supporting resilient membrane.

According to a second aspect of the present invention there is provided a hand utility interface comprising open topped finger channels each finger channel having a structure which grips a finger of a user when the finger is pressed down into the channel through an open top to retain the interface on the users hand, and which is resiliently flexible to be retained even when the fingers of the hand are flexed.

According to a third aspect of the present invention there is provided a hand utility interface comprising open topped finger channels, each finger channel having a structure which grips a finger of a user when the finger is pressed down into the channel through an open top to retain the interface on the users hand, wherein the structure is resiliently flexible to mimic the movements of a users fingers when the fingers are flexed.

According to a fourth aspect of the present invention there is provided a hand utility interface comprising open topped finger channels, each finger channel having a structure which grips a finger of a user when the finger is pressed down into the channel through an open top to retain the interface on the users hand, wherein the interface has a structure such as to enable it to be discarded single-handed by the fingers.

As will be appreciated from consideration of the following detailed description of embodiments of the hand utility interface, the invention may provide an interface with different utilities such as cleaning media, abrasive media, polishing media and many others to perform work while minimising the labour involved by obviating the need for the user to grip a cleaning, brushing or polishing apparatus and enabling an operator to address a greater surface area with each pass of the hand than could be otherwise addressed.

BRIEF DESCRIPTION OF THE DRAWINGS

Embodiments of the hand utility interface constructed in accordance with the present invention will now be described, by way of example only, with reference to the accompanying Figures, in which.

DETAILED DESCRIPTION OF THE DRAWINGS

Any feature described below as a variant may be applied to any embodiment of the invention.

Figure 1:
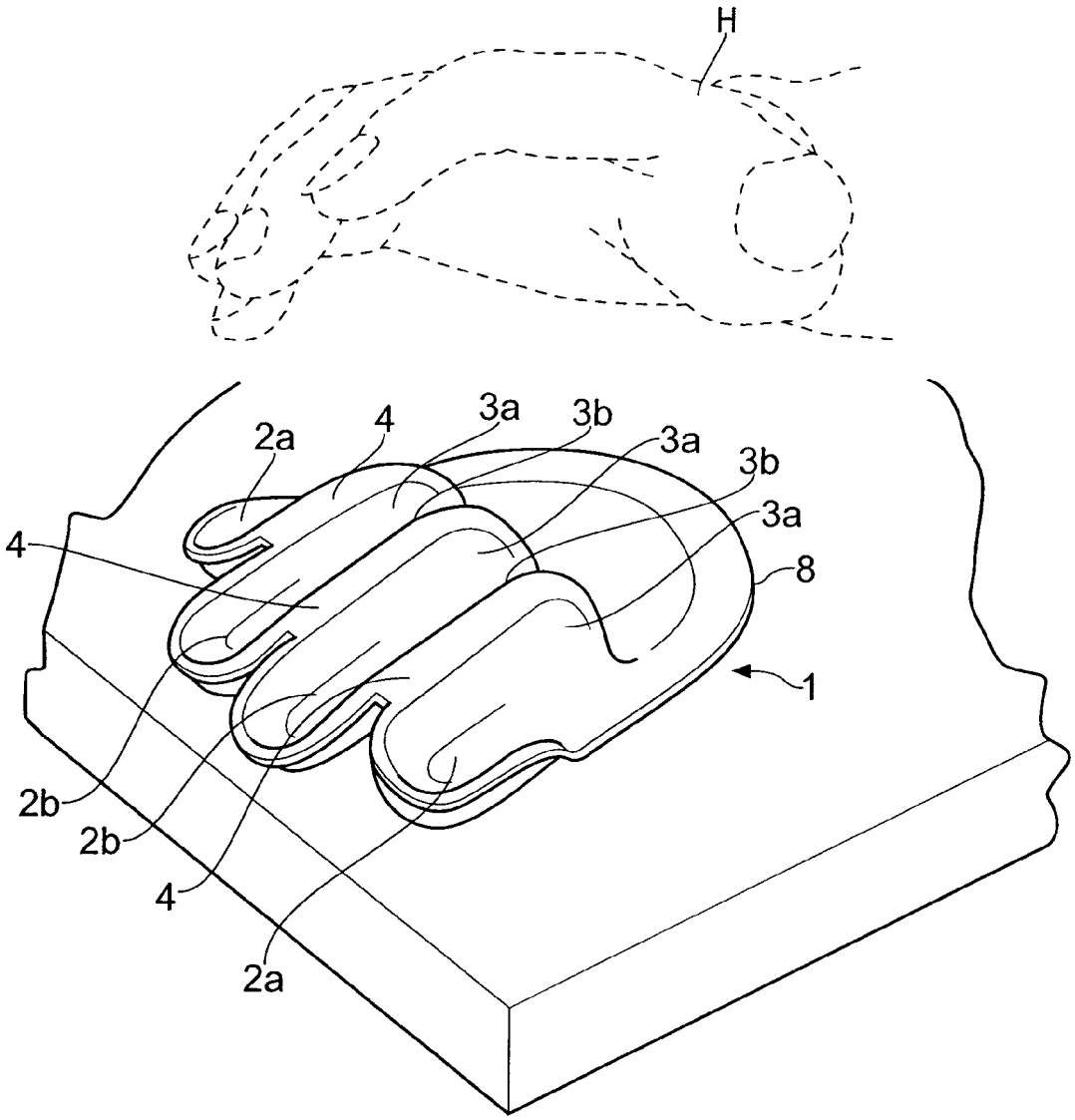
FIG. 1 is a perspective view of a hand descending to engage a hand utility interface according to the invention.
Figure 2:
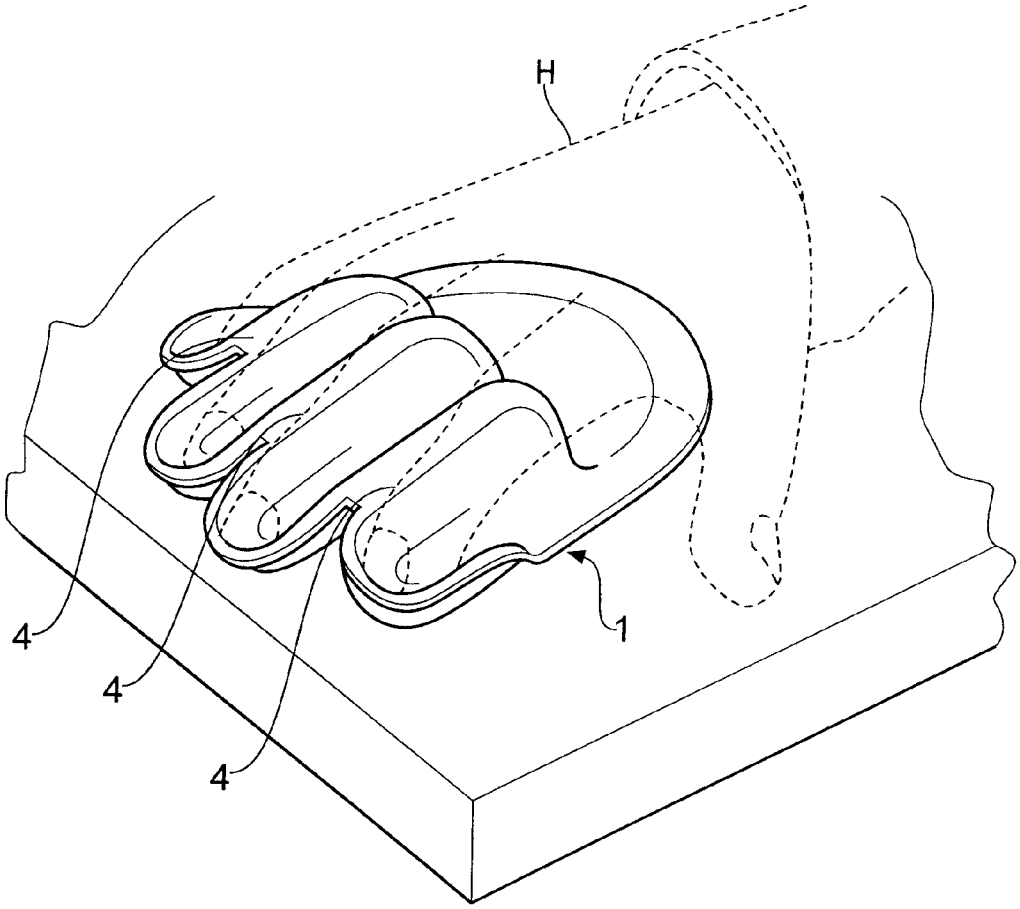
FIG. 2 is a perspective view of the relaxed hand engaged by the interface of FIG. 1.

FIGS. 1 to 8 according to preferred embodiments of the invention illustrate the mode of use of the hand utility interface. As can be seen from these Figures, the hand utility interface 1 is fabricated from a membrane, which although thin, forms a self supporting interface structure. The interface has four open topped finger channels and in the case of this preferred embodiment four finger channels 2*a*, 2*b*. The finger channels 2*a*, 2*b* are each sized and shaped to receive one finger of the users hand "H". The finger receiving channels act to releasably grip the hand utility interface to the users hand when the fingers of the hand "H" are pressed through the open top of each finger channel 2*a*, 2*b* with the fingers of the hand slightly extended and spread. The utility can then be picked up simply by relaxing the fingers and raising the hand as shown in FIG. 2. It should be noted that the user does not need to grip the interface 2; the hand and fingers may remain completely relaxed while the hand utility interface 2 continues to gently grip the hand.

In order to grip the fingers of a hand the inner, medial finger channels 2*b*, have opposing side walls, 3*a*, 3*b* which deform elastically as a finger is pressed in through the open top of each of the channels 2*a*, 2*b*. The preferred structure for achieving this is illustrated diagrammatically in FIGS. 6 and 7. The structure consists of a bridge part 4 which is supported at a height "h" above the middle height "m" of the finger F by the side walls 3*a*, 3*b*. The values of m and h are established from a careful analysis of the known sizes of adult female and male hands so that a single size of the interface can be configured to fit at the least the majority, preferably the great majority of adult female and male hands. The interface is useful, that is to say will cooperate with the hand sizes of:—

British men between the 5th % ile and the 97th % ile

US men between the 7th % ile and the 95th % ile

British women between the 6th % ile and the 98th % ile

US women between 8th % ile and the 98th % ile

Data drawn from People Size—Open Ergonomics Ltd.

It is a desirable feature of the interface that it is not chirral, that is to say it is neither left-handed nor right-handed but can be used ambidextrously by either hand. To achieve this the two longer medial finger channels 2*b* are made of equal length while the short, lateral finger channels 2*a* are of similar length to each other. The interface is symmetric about a medial axis "M" extending between the two central finger channels 2*b*.

Figure 3:
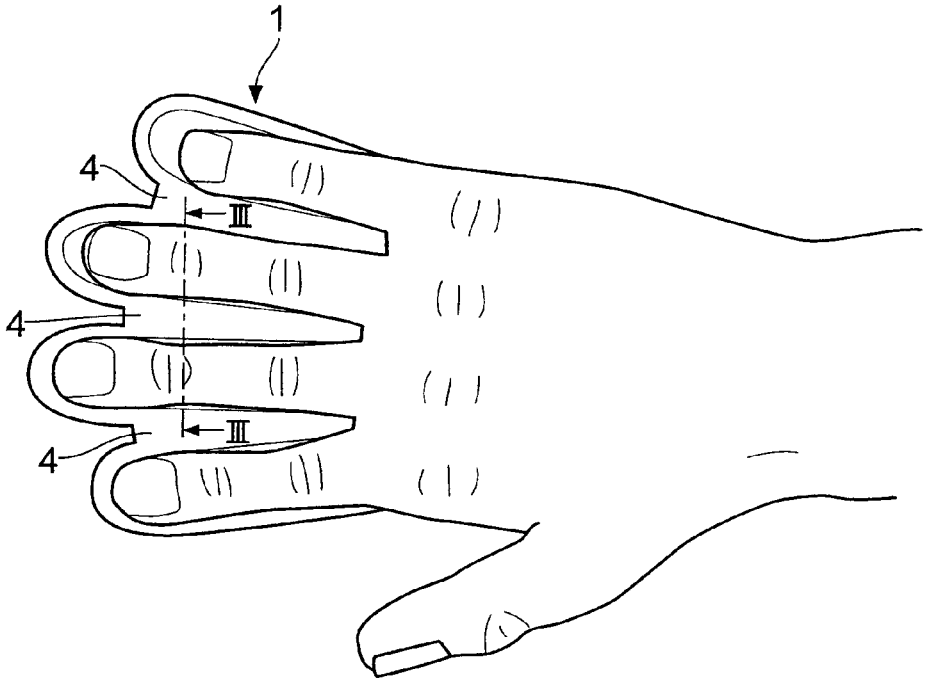
FIG. 3 is a plan view of a small relaxed hand engaged by the interface of FIG. 1.
Figure 4:
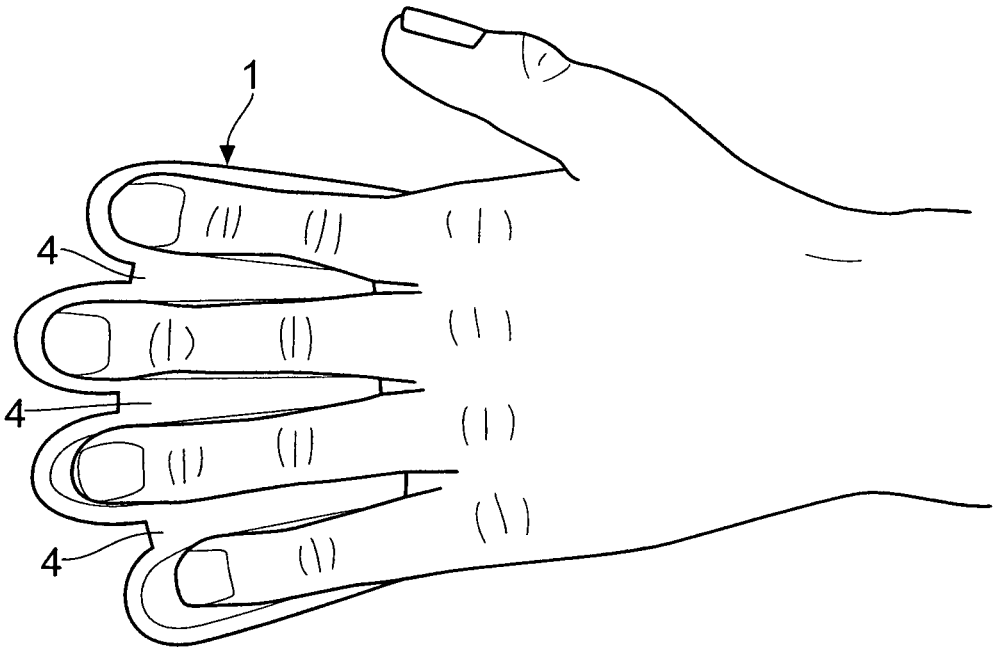
FIG. 4 is a plan view of a large hand gripped in the interface of FIG. 1.
Figure 5:
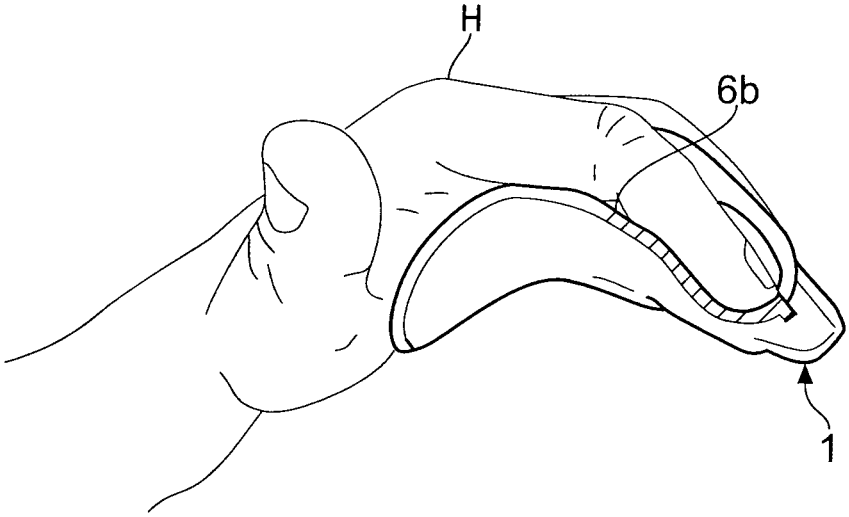
FIG. 5 side section through a lateral finger channel of the interface of FIG. 1.
Figure 6:
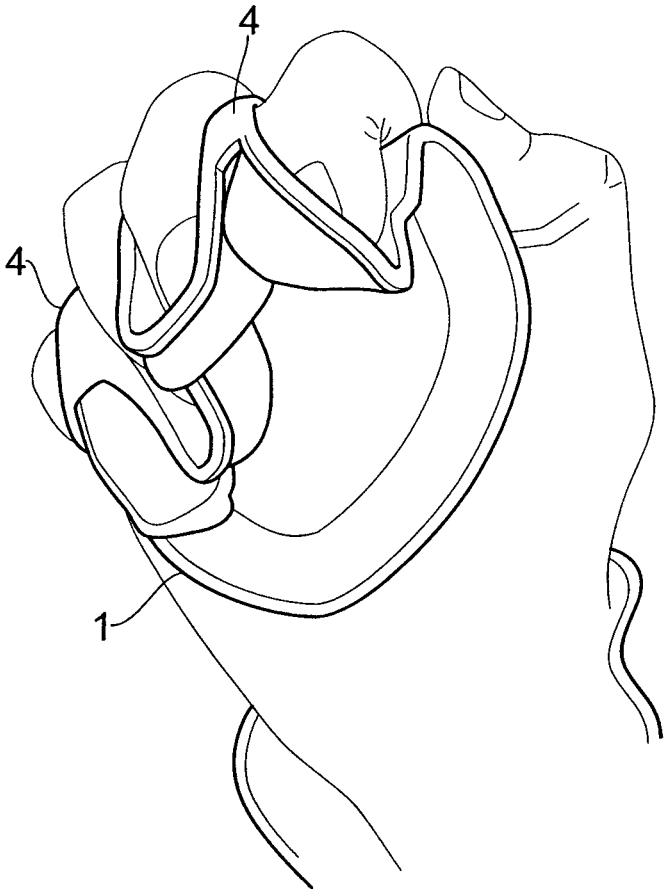
FIG. 6 shows a perspective view of the hand gripped in the interface of FIG. 1 in the process of flexing the fingers.
Figure 7:
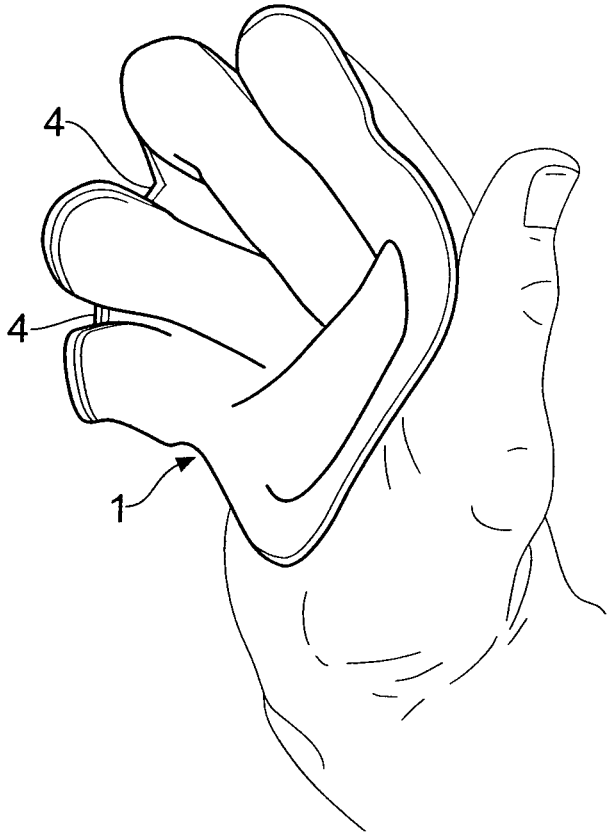
FIG. 7 shows a perspective view of a hand flexing the fingers at different angles whilst gripped by the interface of FIG. 1.
Figure 8:
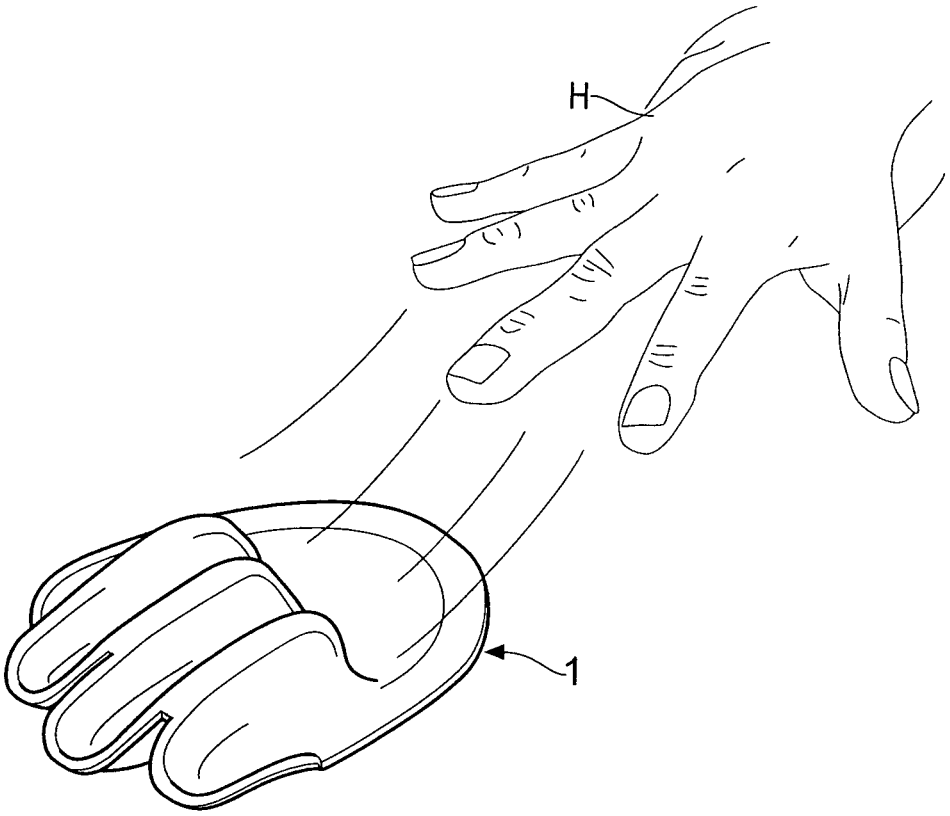
FIG. 8 shows a perspective view of a hand with the fingers extending and spreading to discard the interface of FIG. 1.

The description above explains how the interface grips a finger or more usually fingers on the hand in a relaxed condition, this condition is illustrated in FIG. 2, FIG. 3 and FIG. 4. FIG. 5 illustrates how a base part 6*b* of each finger channel 2*b* is domed to follow the relaxed curvature of a hand. As shown in FIG. 6 the interface 1 is sufficiently flexible and resilient to allow it to be crushed in a fist and to recover its shape many times during use.

The functionality of the interface is further enhanced by the arcuate base shape illustrated in the side elevations of FIGS. 11A, 11D, 13A, 14A and 15B because at least in part as a consequence of this shape the interface can easily be discarded simply by extending the fingers. This causes the fingers to spread so opening the channels and generating an impulse projecting the interface from the hand. The hands may press against the arcuate base part 6*b* shown in FIG. 10B of the interface 1 so that the fingers are encouraged to disengage from the finger channels 2*a*, 2*b*. In the case of some hands in certain forms of the interface, it may prove of assistance to differentially extend the fingers to discard the interface 1 or to discard the interface using a throwing motion in combination with extending the fingers. Thus unlike a conventional glove it is possible to "put on" and readily remove the interface 1 single-handed.

Figure 10A:
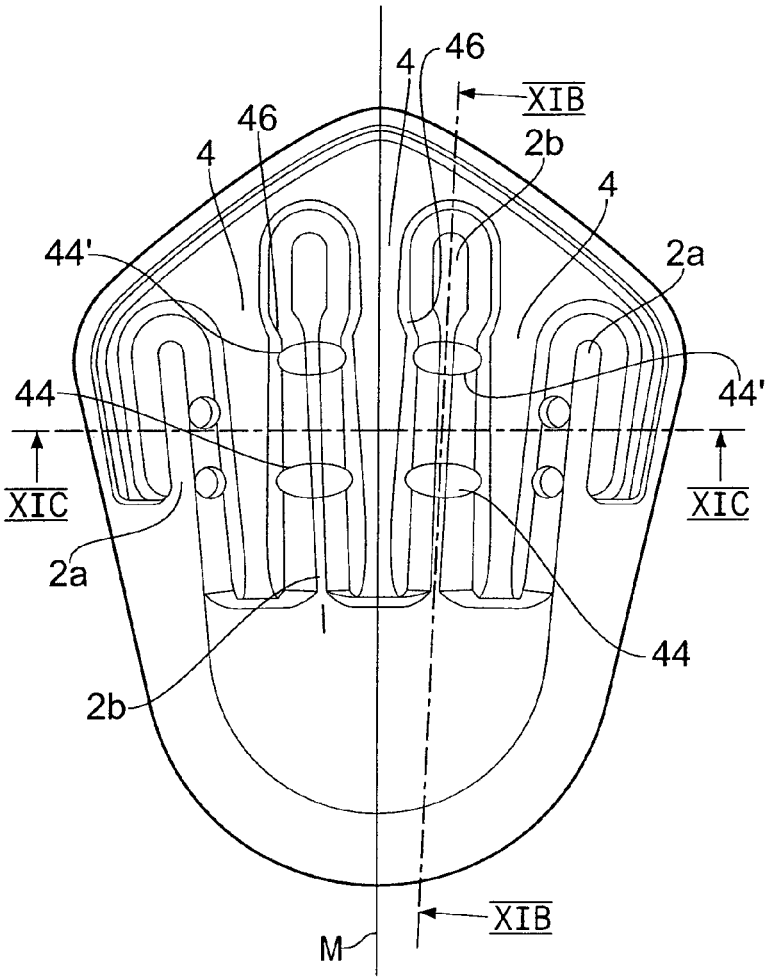
FIG. 10A is a plan view illustrating optimised dimensions applicable to any embodiment of the interface.
Figure 10C:
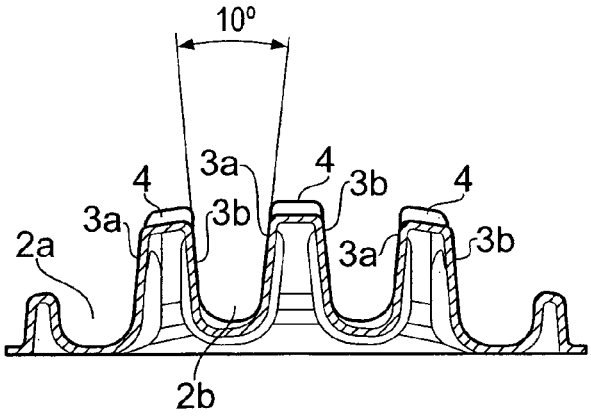
FIG. 10C is a sectional view on the line XIC-XIC illustrating optimised dimensions applicable to any embodiment of the interface.
Figure 10B:
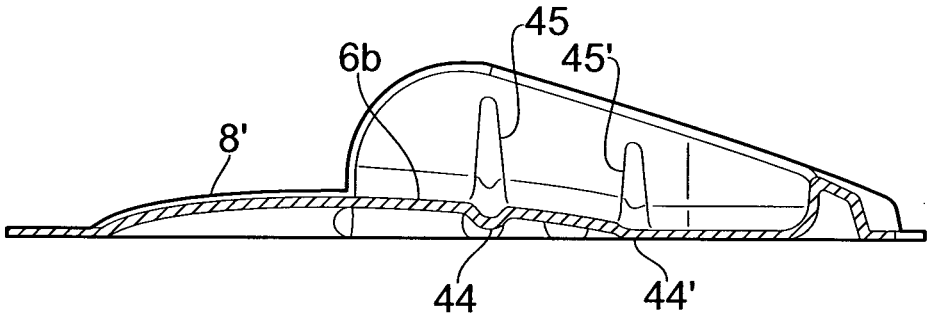
FIG. 10B is a sectional view on the line XIB-XIB illustrating optimised dimensions applicable to any embodiment of the interface.

For the utility of the interface to be maximised it is desirable that a single size of interface fit the largest possible range of hands. After considerable research the inventors have optimised the design of interface for an adult hand. The internal dimensions of the finger channels 2*a*, 2*b* and their relative locations are illustrated in FIGS. 10A, 10B and 10C. These dimensions may advantageously be applied to every embodiment of the interface 1. However, some dimensions may usefully be altered for special applications. For example the angle between the symmetric axis of either one of the medial finger channels 2*b* and the medial axis "M" is shown as 1.5°, this may usefully be altered between as little as 1° to as great as 18°. It may be noted that the radius of curvature "R" of the proximal end of the walls is approximately an arc of a circle and has a radius of substantially 20 mm to promote ease of moulding.

As shown in FIGS. 2 and 3 the sizes of finger channels selected allow the largest usually male hand to fit the fingers into each finger channel 2*a*, 2*b* so that at least the interphalangeal joints of each finger are engaged in the channels 2*a*, 2*b*. If the crotch between the fingers is outside the channels the grip of the interface on the fingers is largely unaltered. Conversely a small sized hand may have the whole of each finger within each corresponding channel, perhaps leaving a space at the fingertip, without significantly altering the grip achieved by the interface 1.

Alternative dimensions optimised for other ranges of hand size are contemplated particularly for the hands of children.

The interface can be crushed in a fist or similarly flexed in order to grip or work around a surface during use.

The bridge part 4 is rendered stiff relative to the sidewalls 3*a* and 3*b*. This can be achieved by a number of mechanisms but in the present case is readily achieved by making the bridge part thick relative to the sidewall parts. This can be readily achieved in a vacuum moulding process used to manufacture the interface. As a finger F is pressed through the open top of each of the finger channels 2*a*, 2*b* the resiliently deformable bridge part 4 elastically deforms to allow entrance of the finger F and then substantially recovers its rest shape. Accordingly the user feels a small degree of resistance as the fingers are pressed into the finger channels. In order to grip the finger the sidewall parts 2*a*, 2*b* deform elastically from the rest condition shown in the left hand finger channel of FIG. 9A to the strained condition shown in the right hand channel, thus the bridge part 4 overlies the finger F to gently lock it in place. The views shown in each of the FIGS. 9A-9G are schematic sections through an interphalangeal joint of the finger locating or located in a finger channel.

The separation of the opposing side walls and the resilience of the material structure are chosen so that the side walls will grip the interphalangeal joints, for a wide range of finger sizes, while permitting the interface to be easily discarded. The relatively stiff bridge part 4 assists in achieving this effect because it acts to constrain and resist the inward collapse of the upper edge of any part of the wall 3. So that this feature is more reliably achieved each finger channel is shaped to taper from a wide end proximal the location of the metacarpophalangeal joint of a hand engaged by the interface, to a distal end. By arranging to grip most significantly the phalangeal joints of each finger it becomes possible to develop an interface able to accommodate a very wide range of hand sizes. A further significant benefit is that such gaps as are left between the sidewalls and the sides of a finger improve ventilation and hence comfort. These features can be appreciated best from FIGS. 3 and 4. FIG. 3 illustrates the fit of an interface to a small adult hand while FIG. 4 exhibits the fit of a large adult hand in the same interface.

It has also been found to be of benefit to incline the opposing sidewalls so that the distance between the bottom edges of the sidewalls is less than that at the top. This feature can be seen in the left channel of FIG. 9A. By inclining the sidewalls 3 the finger channels are better able to fit a wide range of finger sizes.

Figure 9A:
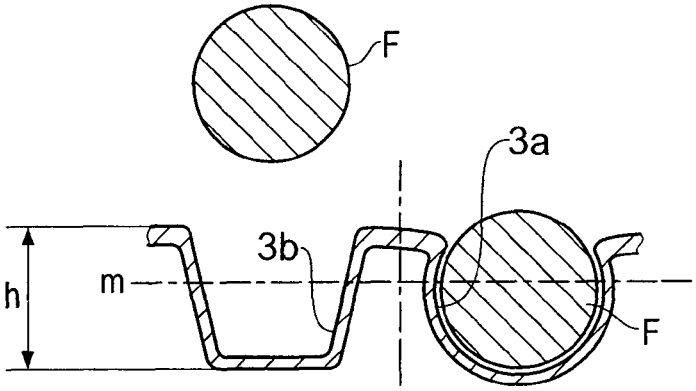
FIGS. 9A to 9C are diagrammatic sectional views on the line III-III in FIG. 3 through two finger channels of an interface showing the gripping structure which is used in a first variant to grip the fingers of a hand.
Figure 9B:
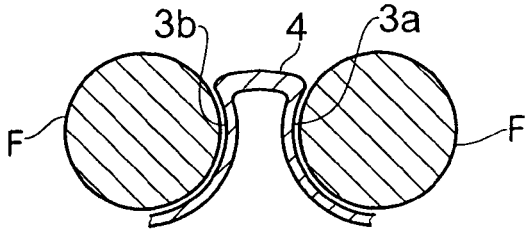
Figure 9C:
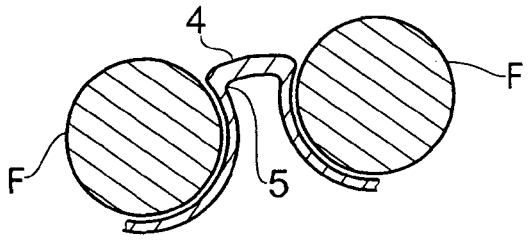
Figure 9D:
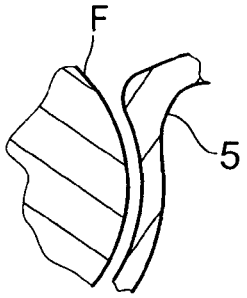
FIG. 9D shows a detail enlargement of the structure in FIG. 9D.

At the time of writing the preferred best performing bridge structure is that shown in FIGS. 9A to 9D. The notable feature of this bridge structure is that it presents a convex uppermost surface. Making the uppermost surface of the bridge part 4 convex tends to guide the fingers of the hand into the finger channels 2*a* and 2*b*. FIG. 9B illustrates two fingers fully engaged one in each of the finger channels 2*a* FIG. 9C illustrates the way in which joins 5 between the edges of the bridge structure and the uppermost edges of the sidewalls 3 are engineered to articulate or hinge resiliently. As a result the finger F gripped in the finger channel can articulate about at least the metacarpophalangeal joint without the interface losing its grip on the finger and with little resistance from the interface. FIG. 9D shows an enlarged detail of the joins 5 illustrating how they are engineered so that the relatively large section of the bridge 4 merges progressively with the each joined wall 3*a* and 3*b*.

Figure 9E:
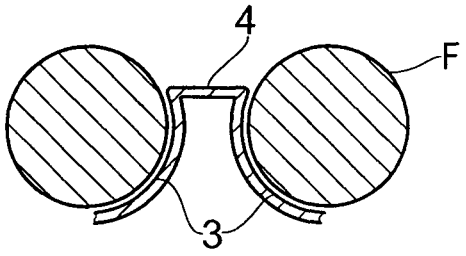
FIGS. 9E and 9F are diagrammatic sectional views showing second and third variants of the gripping structure shown in FIGS. 9A to 9D.
Figure 9F:
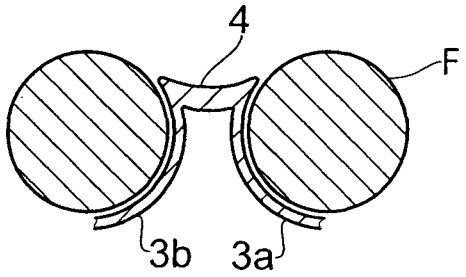

FIG. 9E shows a second variant of the bridge part 4 which is substantially flat. FIG. 9F shows a variant in which the bridge part 4 is concave.

Figure 9G:
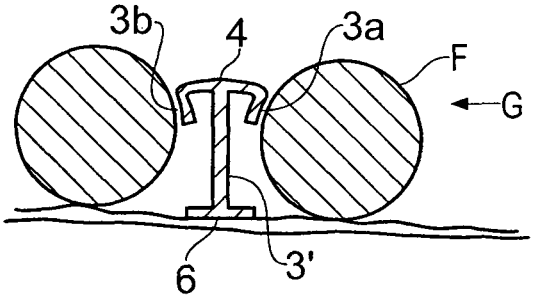
FIG. 9G is a sectional view of fourth variant of the gripping structure, as it would be seen on the line III-III.
Figure 9H:
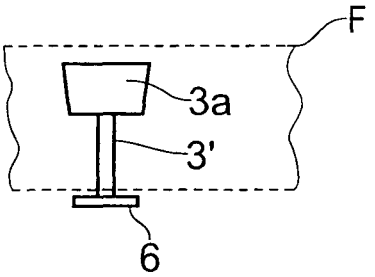
FIG. 9H is a side elevation of the fourth variant structure of FIG. 9G in the direction of the arrow G.

In the bridge structure variant of FIGS. 9G and 9H the bridge part 4 is supported by a member 3' which rises from a base part 6 of the interface. Wall parts 3*a*, 3*b* depend from opposite edges of the bridge part 4 and are urged into engagement with the upper part of the finger by the resilience of the bridge part 4.

Figure 9I:
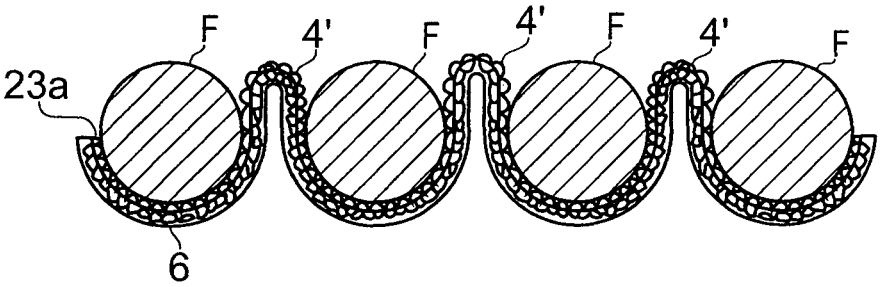
FIG. 9I is a diagrammatic sectional view of a fifth variant.

FIG. 9I shows a variant of the interface which has no distinct bridge part. A curved or arched part 4' is formed integrally from the media and may be treated to be stiffer than the wall parts 3*a* and 3*b*. The media 23 may be an abrasive, or cleaning material. The upper surface of the media may be provided with a comfort layer 23*a*.

Figure 9K:
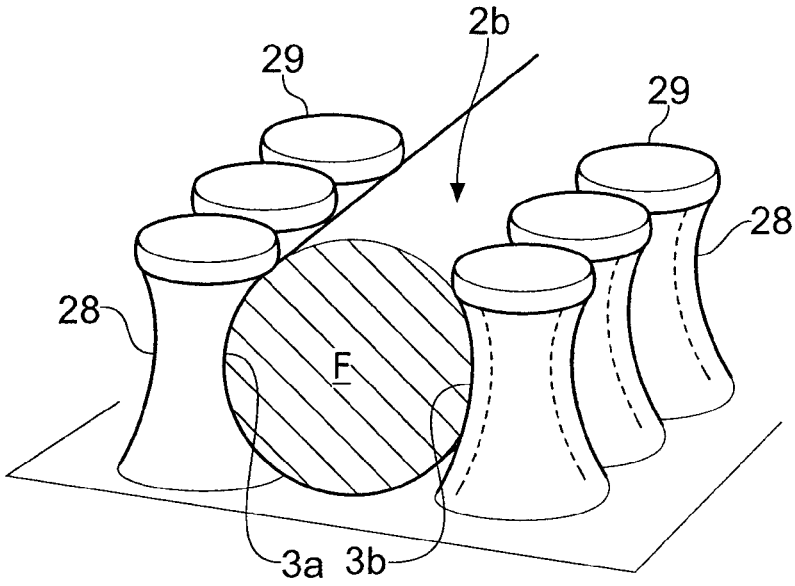
FIG. 9K is a diagrammatic perspective view of seventh variant of the gripping structure.
Figure 9L:
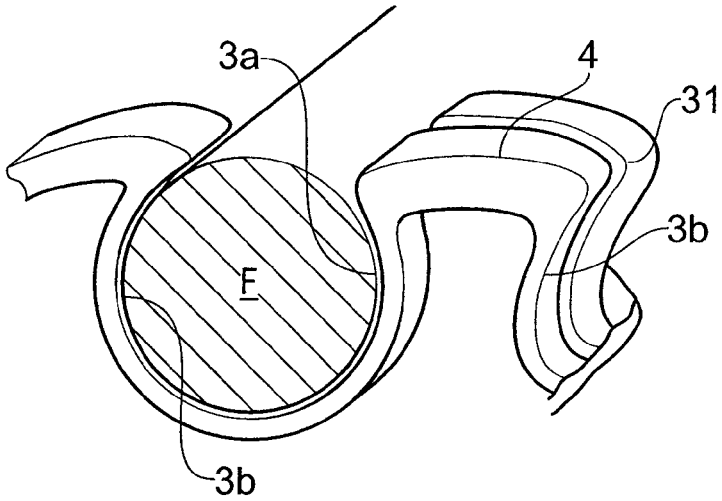
FIG. 9L is a diagrammatic perspective view of a seventh variant of the gripping structure.
Figure 9J:
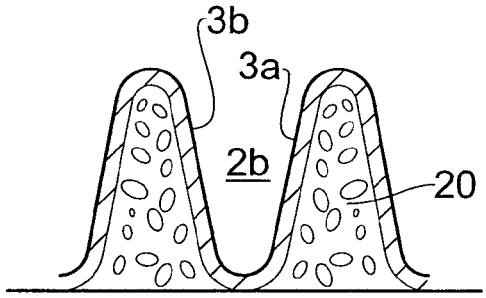
FIG. 9J is a diagrammatic sectional view of a sixth variant.

FIG. 9J discloses a variant in which the self supporting membrane is moulded to form self supporting side walls 3*a*, 3*b* which define "U" shaped finger channels 2. The structure lacks a distinct bridge but simply rolls over to form the walls of the adjacent channel. Resilience to grip a finger is provided by subsequently packing the space 20 between the walls with a resilient material such as a resilient foam.

FIG. 9K illustrates an variant wherein the finger channels 2*a*, 2*b* are provided by opposing sides of individual upstanding rows of resiliently deformable hollow posts 28 integrally moulded from the membrane of the interface 1. Each hollow frusto-conical post 28 tapers from a base to a head part 29. Pressure applied by a finger "F" causes the engaged post wall to deform resiliently as shown. The head 29 is located to serve the function of the bridge part 4 and to resiliently deform and recover as a finger "F" is pressed down into the channel 2*b*.

FIG. 9L presents a further variant of the invention wherein the wall parts 3*a*, 3*b* support a bridge part 4 but in order to maximise flexibility of the interface with the hand these parts are separated by numerous laterally extending channels 31.

Figure 11A:
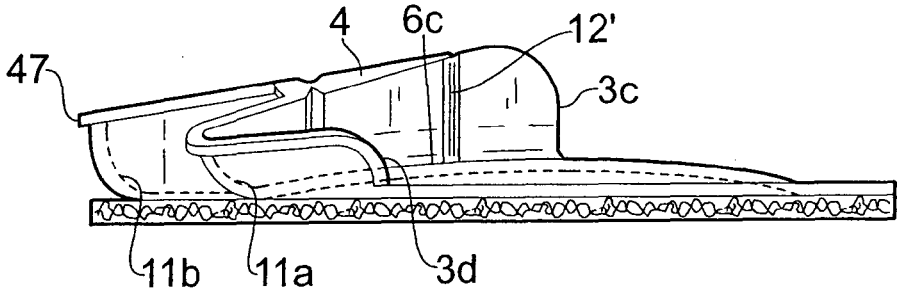
FIG. 11A is a side elevation of a first detailed embodiment of the interface.
Figure 11B:
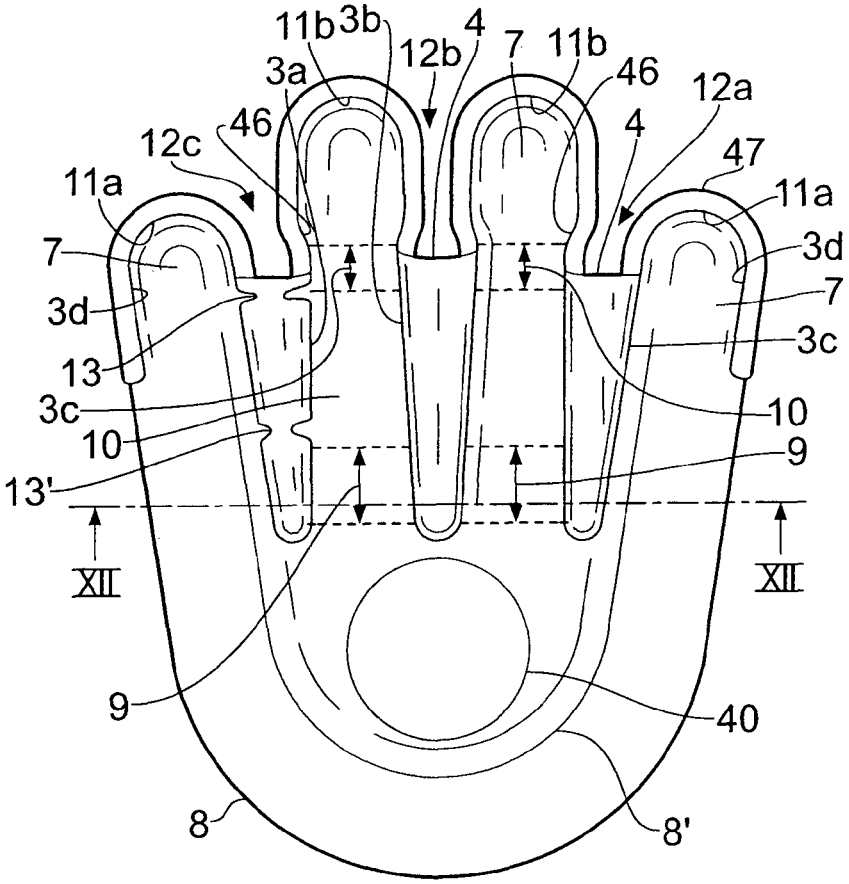
FIG. 11B is a plan view of the first detailed embodiment of the interface.

While the arrangements of the bridge described above grip the interface to the hand in the relaxed condition, the hand can be further discouraged from slipping from the interface during use by the provision of a polished surface, particularly in the region of the fingertips and under the fingers as shown at 7 in FIG. 11B. Producing a polished surface finish in the region of the fingertips results in stiction between the fingertips and the interface assisting in providing an effective grip. The polished surface finish 7 can easily be achieved during the production process by producing a correspondingly polished finish on the corresponding surface of the mould. It has been found that a finish corresponding to an Ra value of 0.1μ or less is effective. Polished regions may be implemented where desired on any embodiment of the invention.

A roughened finish can be effected in much the same way for a similar purpose but will often not be preferred because its comfort and appearance may be unattractive to a user.

Many of the benefits of the present invention over the applicant's previous developments of a hand utility interface arise directly from the fabrication of the interface from a thin self-supporting membrane and from the selection of the materials for that membrane which results in a hand utility interface which is light resilient and flexible and has properties capable of adopting a range of attractive textures and colours. Each embodiment of the invention is formed from a single sheet of a thin flat membrane. The membrane is no less than 0.5 mm thick and not more than 5 mm, preferably it is between 1.5 and 3.5 mm thick and the presently preferred thickness is 2.5 mm, however the thickness of the stock membrane can readily be selected in order to adapt the hand utility interface to a range of applications. Preferably the hand utility interface is moulded by an inexpensive moulding process such as vacuum forming and press moulding although other forms of moulding such as injection moulding are possible manufacturing processes. A particularly suitable material or range of materials for this manufacturing process is described in detail in the various examples below.

EXAMPLE 1

The self supporting membrane is a material shaped by means of a vacuum forming process, a common method of plastics moulding. The membrane material comprises: physically cross linked, closed cell soft polyolefin foam, deriving from a process employed by Sekisui Chemical co. Ltd, Japan, as detailed below:—The product specifically used is commercially referred to as Alveolit TEE M 1502 and Alveolit TLG M 1503 and was manufactured in Europe by a subsidiary of Sekisui ALVEO AAG, although it may be supplied from any of Sekisui's worldwide foam operations and/or subsidiary companies.

The product's formula derives from the following process:

blending a composition comprising: (i) 10-100 parts by weight of a ethylene polymer selected from vinyl acetate copolymer (EVA), ethylene ethylacrylate (EEA), ethylene acrylic acid (EEA), ethylene butylacrylate (EBA), very low density polyethylene (VLLDPE), metallocene PE's and combination thereof. In the present invention, EVA is the preferred polymer of choice, with a vinyl acetate content of between 3 and 70% by wt-%, preferably 5-30 wt %, even more preferably 14% by wt. The above ethylene polymer should have a Melt Flow Index (MFI) of 0.1 to 15 g/10 min at 190° C. and 2.16 kg (determined by BS EN ISO 1133:2000) with a chemical blowing agent (or foaming agent) such as azodicabonamide, with no restrictions of alternative types such as hydrazine compounds, carbazides, tetrazoles, nitroso compounds or carbonates. In the present invention, azodicarbonamide is used preferentially.

For a skilled person the MFI gives a measure of the flow characteristics of a polymer and a rough indication of the molecular weight and processing behaviour.

Additionally, as required, other substances are added to the blend to facilitate processing. These are namely, phenolic antioxidants, process internal lubricants such as ZnSt, and blowing agent activation materials such as ZnO. In certain cases appropriate colour pigments are added to enable final product colouration;

forming a sheet like material preferably by an extrusion process (either single screw or twin screw types), wherein the blending of the composition with the chemical blowing agent is performed prior to and/or simultaneously with the forming; In a preferred embodiment, this process step is made at a temperature less than the activation temperature of the CBA, namely between 130° C. and 160° C., with 145° C. being the optimum. Cross linking the sheet like material obtained in step b to a cross linking degree of 20-60% (preferably 40%) as measured according to ASTM 2765 using xylene as a solvent to dissolve non-cross linked components. By means of any common cross linking process i.e. chemical or physical cross linking—with physical cross linking with a high energy electron beam ionising process being particularly preferred. The cross linking degree is an expression of the weight % of cross linked material that remains; and foaming the cross linked sheet like material at an elevated temperature (230° C.) in a continuous process, to obtain a foam having a density of 20 to 400 kgs/m3 preferably 67 kg/m3 (as measured by ISO 845), and a thickness of 0.5-10 mm, preferably 2 mm.

The foaming is preferably conducted in a vertical and/or horizontal oven system. The cell size is preferably from about 0.05 to around 2 mm, preferably from around 0.1 to 0.6 mm. The cell size is measured by scanning electron microscopy.

The foam in the present invention is a soft foam. The softness can e.g. be expressed by the low compression strength values of the foam determined by ISO 844. These are preferably in the range of 25 to 60 kpa measured on a foam with a density of 70 kg/m3 at a deflection of 25%.

Foam Composition 1—TEE M 1502

A commercial EVA ethylene co-polymer with a VA content of 14% and a MFI of 4.0 g/10 min, is blended and compounded and moulded with an appropriate quantity of azodicarbonamide-around 7.1% by wt to achieve 67 kg/m3-, Zno, Znst, phenolic antioxidant and colourant in a single screw extruder at a compounding temperature of 145° C. The resultant sheet is cross linked to a 45% level using an electron beam irradiation system, and vertically foamed at 230° C. to result in a soft foam of density 67 kg/m3, and thickness 2 mm, with a fine closed cell structure averaging 0.2 mm, providing a compression strength of 30 kpa at 25% deflection.

Foam Composition 2—TLG M 1503

70% by wt %-of a commercial EVA ethylene co-polymer with a VA content of 14% and a MFI of 4.0 g/10 min, is blended with 30% by wt %-of a linear low density polyethylene, with a co-monomer based on C4, C6 or C8 (preferentially C8) and a MFI of 4.5 g/10 min, and compounded and moulded with an appropriate quantity of azodicarbonamide-around 7.5% by wt to achieve 67 kgs/m3, Zno, Znst, phenolic antioxidant and colourant in a single screw extruder at a compounding temperature of around 155° C. The resultant sheet is cross linked to a gel fraction level of 45% using an electron beam irradiation system, and vertically foamed at 230° C. to result in a soft foam of density 67 kg/m3, and thickness 3 mm, with a fine closed cell structure averaging 0.2 mm, providing a compression strength of 40 kpa at 25% deflection.

EXAMPLE 2

Alternative suitable materials have been especially developed by Trocellen GmbH as detailed below:

Foam A:

foam with density of 100 kg/m$^3$:

type: "Trocellen C 10003 DO3", commercially available by Trocellen GmbH, Germany;

main properties: closed cell polyethylene foam, chemically crosslinked, high flexibility, density 100 kg/m$^3$, thickness 3 mm (before thermoforming);

Foam B:

foam with density of 140 kg/m$^3$:

type: "Trocellen C 14003 DO3", commercially available by Trocellen GmbH, Germany;

main properties: closed cell polyethylene foam, chemically crosslinked, high flexibility, density 140 kg/m$^3$, thickness 3 mm (before thermoforming);

These materials present advantageous characteristic properties as indicated below:

| PROPERTY | | TEST METHODS | UNIT | C 10003 DO3 | C 14003 DO3 |
|---|---|---|---|---|---|
| Thickness | | ISO 1923 | mm | 3.10 | 2.9 |
| Density | | ISO 845 | kg/m$^3$ | 111.5 | 141.2 |
| Compression stress strength | 10% | ISO 3386/1 | kPa | 33 | 56.15 |
| | 25% | | kPa | 62.33 | 93.94 |
| | 50% | | kPa | 158.67 | 219.29 |
| Tensile strength | Longitudinal | ISO 1798 | MPa | 1.57 | 1.61 |
| | Transversal | | MPa | 1.25 | 1.54 |
| Elongation at break | Longitudinal | ISO 1798 | % | 323.5 | 363.2 |
| | Transversal | | % | 432 | 445.2 |
| Tear strength | Longitudinal | DIN 53 507 | N/mm | 3.89 | 3.97 |
| | Transversal | DIN 53 507 | N/mm | 3.34 | 3.78 |
| Compression set | 25%, 30', 23° C. | ISO 1856 | % | 6.04 | 8.01 |
| | 25%, 22 h, 23° C. | | % | 0.45 | 1.64 |
| Compression set | 50%, 30', 23° C. | ISO 1856 | % | 31.43 | 29.77 |
| | 50%, 22 h, 23° C. | | % | 10.21 | 7.36 |
| Fire behaviour | Flame speed | DIN 75200 | mm/min | 160 | 89 |
| Shore | Shore 0 | ASTM D 2240 | Shore | 31 | 32 |
| | Shore 00 | ASTM D 2240 | Shore | 64 | 67 |
| | Shore A | ISO R.868 | Shore | 25 | 28 |
| | Shore D | ISO R.868 | Shore | 2 | 3 |
| Conditioning | Conditioning time | | Hours | >72 | >72 |
| | Temperature | | ° C. | 21 | 21 |
| | Humidity | | % | 40 | 42 |

A further possible material of use is Ethylene Propylene Dimonomer (EPDM) a terpolymer elastomer. This produces a particularly soft feeling flexible interface.

By manufacturing the interface from the materials described many of the required properties of resilience and flexibility, and durability texture and appearance can readily be imparted to the interface. Further changes in appearance texture and utility can be achieved by the application of other surface materials prior to or during the blow moulding stage. For example, flocking can be deposited on the surface of the membrane prior to blow moulding, which then forms a textured lining to the hand engaging surface of the interface.

First Detailed Embodiment

Figure 11C:
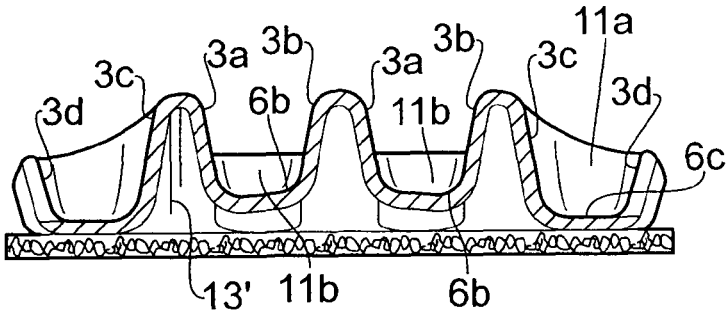
FIG. 11C is a sectional view on the line XII-XII in FIG. 12B.

The detailed first embodiment of the hand utility interface shown in FIGS. 11A-11C consists of a formation of four finger channels 2*a*, 2*b* diverging from a palm supporting part 8 as can be seen in FIG. 11A the palm supporting part 8 continues to follow the curvature of the base parts 6*b*. The palm supporting part 8 is also curved in a plane perpendicular to the palm and the symmetric axis of the interface to form a dome the extent of which is indicated at 8' in FIG. 11A which complements the natural relaxed condition of the palm of the hand.

Each of the long medial finger channels 2*b* is axi-symmetric, and the axis of each finger channel diverges from the median axis of the interface at an angle of about 1.5° when at rest. A proximal end of each medial finger channel 2*b* adjacent the palm part is substantially 18 mm in width at the top of the channel. Upstanding sidewalls 3*a*, 3*b* diverge from the edges of the base of the finger channel 2*b* with an angle of substantially 10° between them. The opposing sidewalls 3*a*, 3*b* converge from the proximal end of the finger channel 2*b* past the position 9 (indicated between the dashed lines) corresponding to the proximal interphalangeal finger joint until they reach a position corresponding to the position 10 (between the dashed lines) of a distal interphalangeal joint of a finger received into the finger channel 2*b*. At a distal interphalangeal joint position 10 the width of the channel 2*a* is substantially 16 mm. This taper of the sidewalls encourages engagement thereof with the interphalangeal joints of a finger. In a tapering region of the finger channel the resilience of the sidewalls and bridge part 4 are able to accommodate a wide range of finger sizes, however at the tip of the finger channel the end wall 11*a*, 11*b* which protects the fingertips of a user greatly restricts the displaceability of the adjacent sidewalls. To accommodate this, particularly when used by users with large hands, the tip end of the finger channel is widened at 46, as shown in FIG. 10A and FIG. 11B in this case to a width of some 17 mm distal of the position 10 of the distal interphalangeal joint. Furthermore the sidewalls in this region are made more vertical relative to the proximal sidewall and in relation to the base plane.

Referring now to the lateral finger channels 2*a*, in FIGS. 11A-11C in the embodiment shown these short lateral finger channels are asymmetric, each having a long medial side wall 3*c*, opposing a short lateral side wall 3*d* which extends back from the finger channel tip wall 11*a* to the distal interphalangial joint position 10. However it should be noted that the lateral side wall 3*d* of 11A may be extended further back to the position 9 of the proximal interphalangial joint or even the position of the metacarpolphalangial joint.

As can best be seen from FIG. 11C, the base parts 6*b* of each of the long medial finger channels 2*b* are each raised above the base parts 6*c* of the short lateral finger channels 2*a*. This further enhances the grip of the sidewalls on the fingers, when the fingers press against the base parts 6*b* during use the base parts 6*b* will be depressed and urge the sidewalls of the medial channels inwardly. This arrangement also provides for a chamber 6*a* beneath the interface to accommodate other auxiliary apparatus as shall be described later.

As can be seen in FIG. 11B the distinguishing feature of this first embodiment of the invention is the provision of a gap 12*a, b, c* extending between the tips 11*a*, 11*b* of the walls of each of the finger channels 2*a*, 2*b* back to the distal interphalangeal joint 10. This enhances the sensitivity and flexibility and improves access to confined spaces and crevices for this embodiment. Enhanced protection for a users fingertips may be provided by a lip 47 which extends around the uppermost edge of the channel walls 2 and channel tip walls 11.

An advantage of fabricating the interface of the invention from a membrane is the facility to introduce various other structural features to enhance the flexibility and stiffness of the structure in a controlled manner, and in particular locations so that flexibility and stiffness can be encouraged in particular directions as required. This first embodiment of the invention exhibits certain of the features as described below. However it must be understood that these features may be implemented alone or together in any embodiment of the invention in order to optimise the interface for any particular application.

Referring to the plan view of the first embodiment of the invention and FIG. 11B, particularly to the right-hand side of the medial axis, the bridge part 4 and sidewalls of the finger channels 2*a*, 2*b* are simple and unmodified. The sidewalls between the medial and lateral finger channels to the left of the medial axis exhibit a "V" section structure 13 which can be seen in hidden detail. A similar "V" structure 13' is provided in the region of the proximal interphalangeal joint 9. This "V" structure 13 serves to increase the flexibility, in the direction of flexure of the fingers, of the medial wall of the lateral finger channel 2*a*, and of the lateral wall of the medial finger channel 2*b*. Particularly in the case of very thin-walled interfaces, it will also help to keep the wall self-supporting. In all cases these "V" shaped grooves in opposing medial and lateral walls project into the cavity beneath the bridge 4 in opposition to each other and may be arranged to touch. This functions to strengthen the wall and increase the wall resilience against the inward pressure applied by the finger joints. It should be noted that the location of these features along the finger channel is chosen with care to avoid coincidence with the position 9 or 10 of either interphalangeal joint.

Figure 11D:
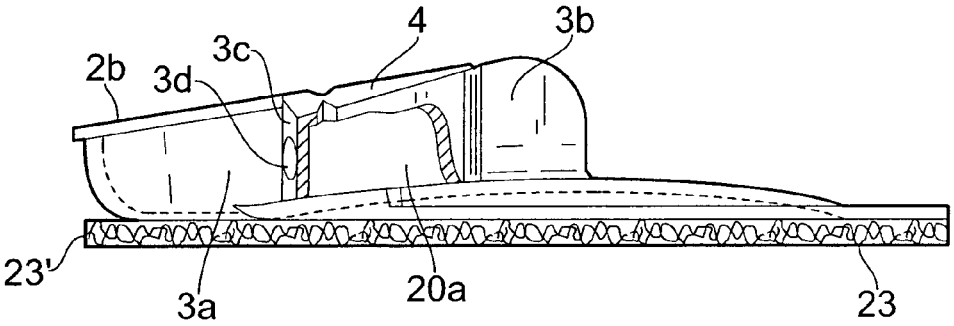
FIG. 11D is a side elevation of a first variant of the first detailed embodiment with the lateral finger channel cut away.

FIG. 11D shows a side elevation of the first embodiment with the lateral finger channel 2*a* cut away and part of the side wall 3*b* sectioned out. A wall 3*c* is formed to depend from the end of the bridge part 4 and between the side walls 3*a* and 3*b* of the adjacent finger channels 2*a* and 2*b*. The wall may be pierced by an aperture 3*d* which communicates through the wall 3*d* to a chamber 20*a* formed in the space 20 between the bridge part 4, the side walls 3*a*, 3*b* and the media. The aperture may be adapted to receive the nozzle of a charge bottle (not shown) able to discharge a flowable material to charge the chamber 20*a*. This material may then leak through a media 23 or be discharged through the aperture by squeezing the side walls.

Figure 11E:
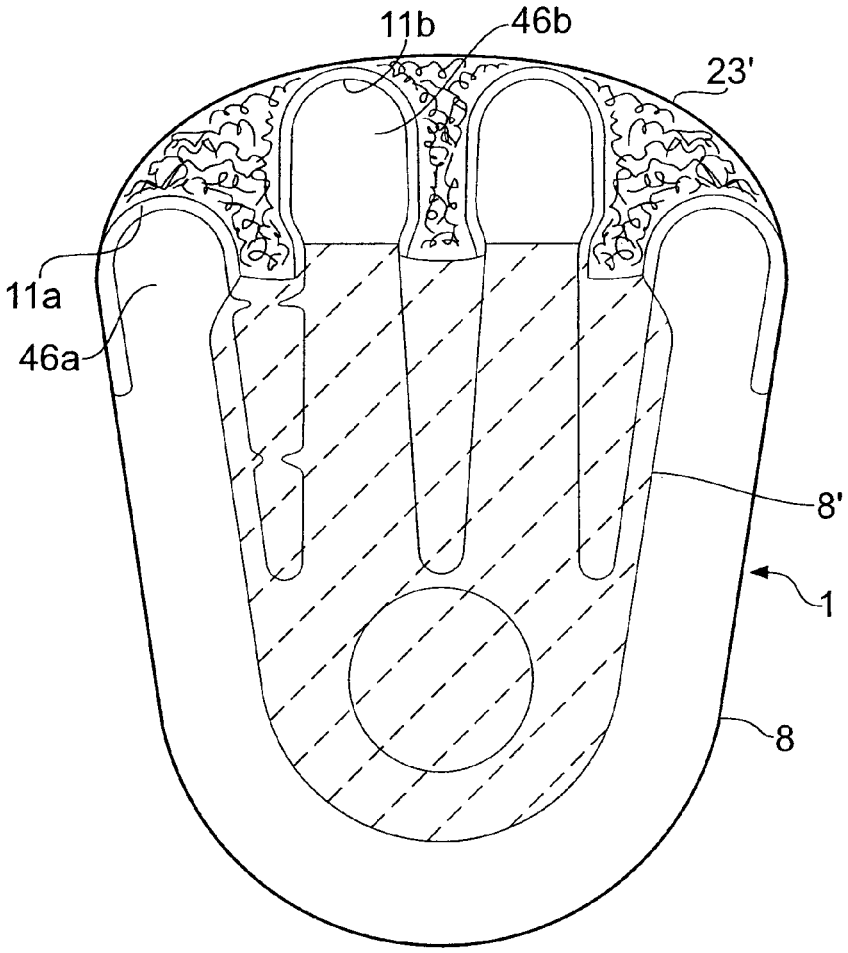
FIG. 11E is a plan view of a second variant of the first detailed embodiment.

FIG. 11E illustrates a second variant of the first embodiment in which a media 23 is secured to the bottom of the interface 1. Notably the leading edge 23' of the media 23 extends in an arc forward of the finger channel tips 11*a*, 11*b*. The region shown with broken shading indicates the extent of the domed portion 8' of the interface 1 which is raised above a plane of the interface 1. The remaining area of the underside of the palm part 8 and finger channel tip regions 46*a*, 46*b*, are flat at rest and lie in a common plane. These flat regions provide a good surface for securing the media 23 to the interface. The process of securing may be via; adhesives, welding, mechanical fastenings, hook and eye fabric fastenings or any other suitable means.

Figure 11F:
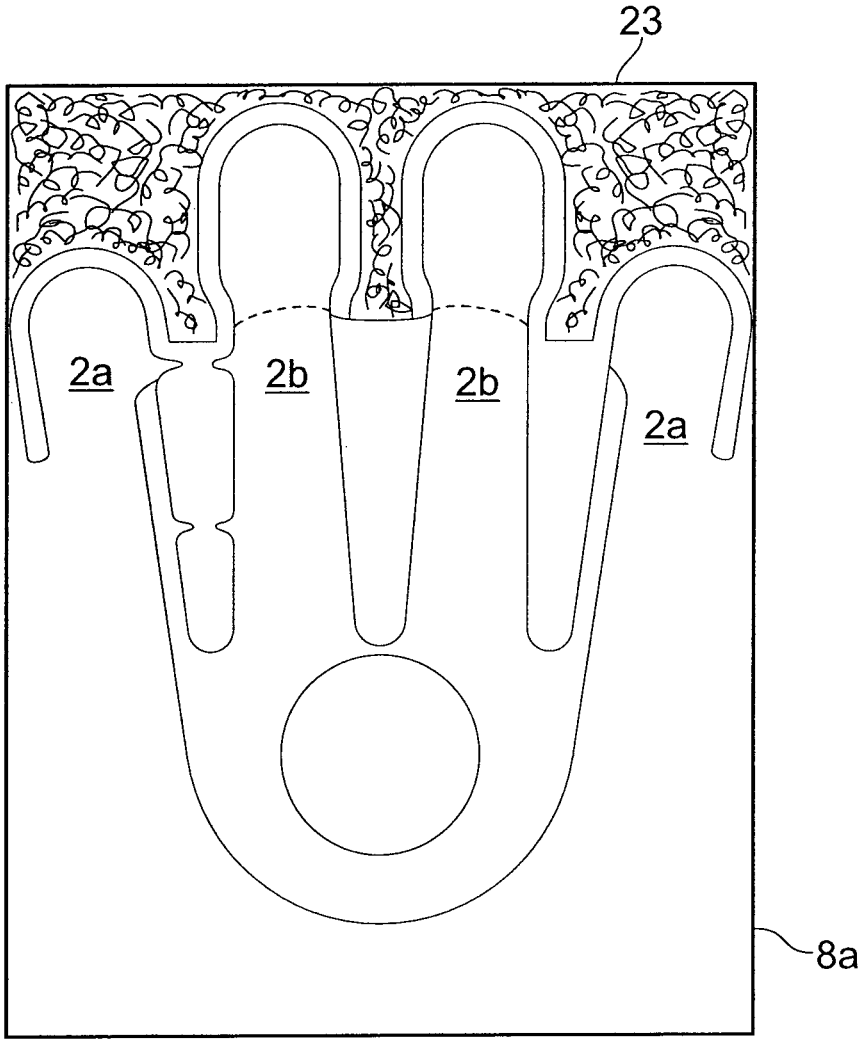
FIG. 11F is a plan view of a third variant of the first embodiment.

In the third variant of the first embodiment shown in FIG. 11F the media 23' is rectangular in plan and extends back under the palm part 8*a*. The palm part 8*a* is also of rectangular plan form.

Figure 12:
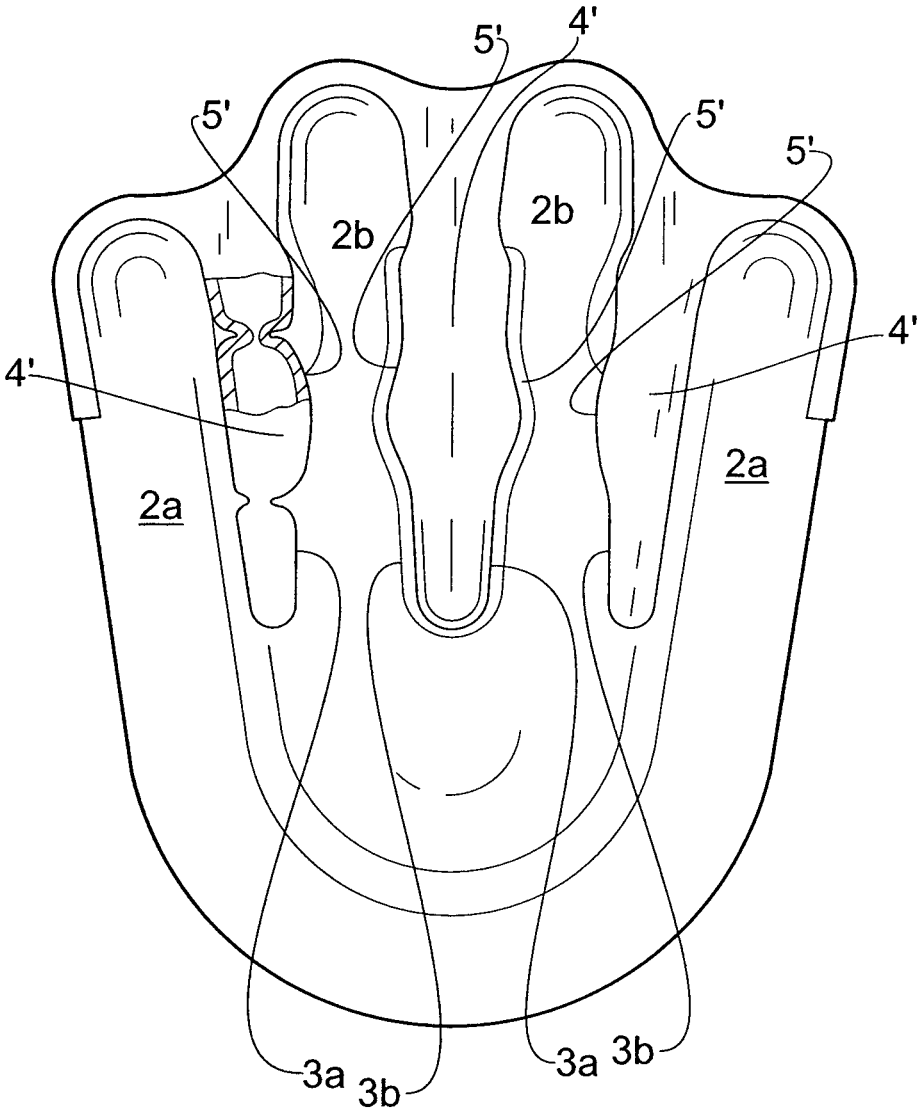
FIG. 12 is a plan view of a variant of the interface.

FIG. 12 illustrates a variant which may be applied to any detailed embodiment of this invention. In this embodiment it will be seen that the upper edge of the side walls 3*a*, 3*b* of each of the medial finger channels 2*b* are retained by the edge of a bridge structure part 4'. This bridge structure part 4' has edges contoured particularly at 5' to closely follow the contours of a corresponding finger (not shown) thus the side walls 3*a*, 3*b* press snugly against the length of the finger and not just the interphalangeal joints.

Second Detailed Embodiment

Figure 13A:
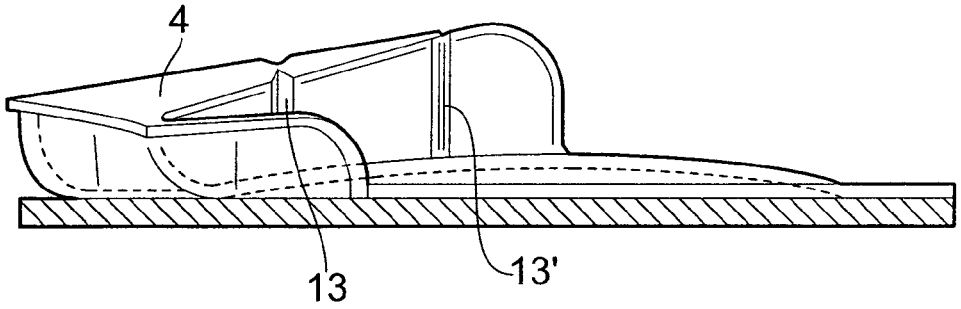
FIG. 13A shows a side elevation of the second embodiment.
Figure 13B:
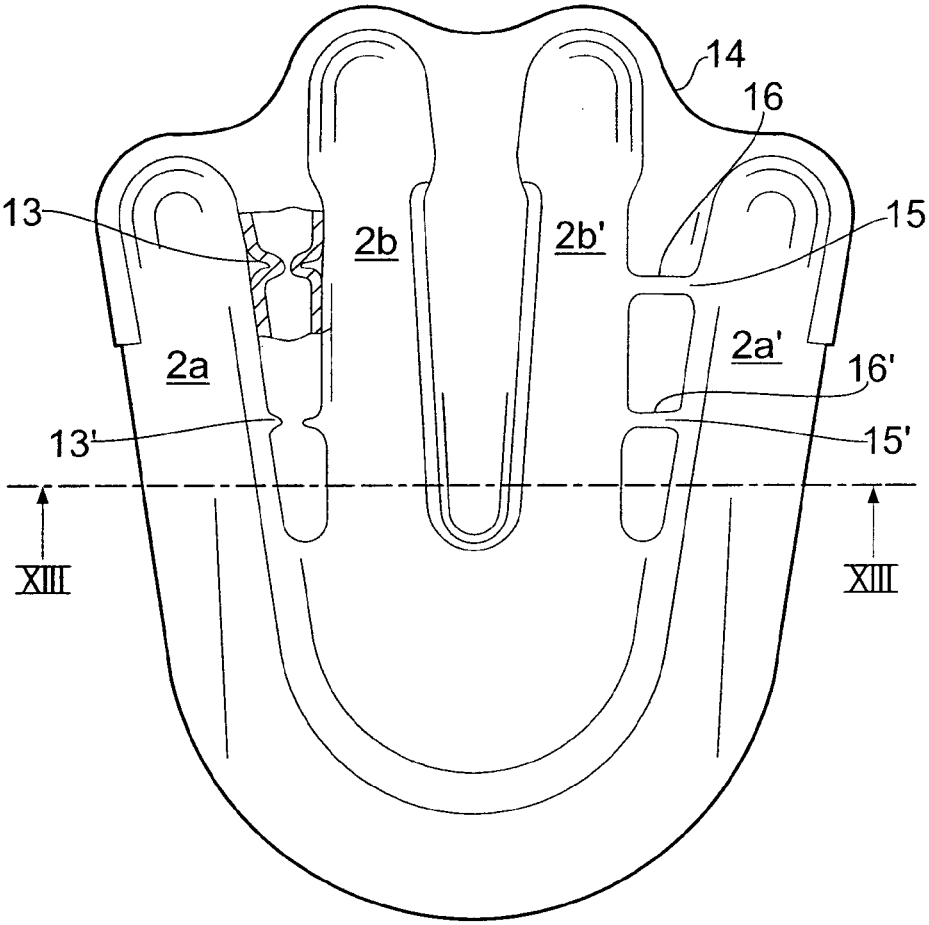
FIG. 13B is a plan view of the second embodiment.
Figure 13C:
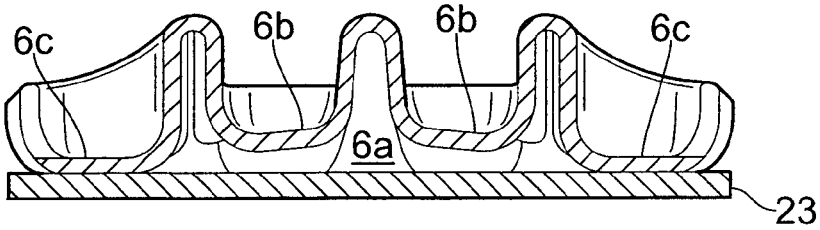
FIG. 13C shows a section on the line XIII-XIII

FIGS. 13A, 13B and 13C show a second embodiment of the invention distinguished from the first embodiment mainly in that instead of a gap 12 a web 14 extends between and around the tips 11 of the finger channels. This may act to improve the protection afforded a user by the interface 1. In the structure shown to the left of the medial line, a "V" shaped groove 13 similar to those provided in the first embodiment is present. However an alternative structure is shown to the right of the medial line in FIG. 13B. The opposing lateral and medial sidewalls of the medial and lateral finger channels are discontinuous at 15 and 15' these discontinuities positioned to avoid correspondence with the positions of the respective distal and proximal interphalangeal joints. The respective opposing sidewalls are joined by bridging walls 16 and 16' which bound the discontinuities. It will be appreciated that the discontinuities increase the flexibility of the walls in the direction of flexure of the fingers. As with the "V" sections they increase the rigidity of the walls against lateral collapse promoting the possibility of constructing the interface from very thin membrane, perhaps as thin as 1.5 mm.

In other un-illustrated variants of the interface, as few as one discontinuity may be present between finger channels and in others three or more may be provided.

Figure 14A:
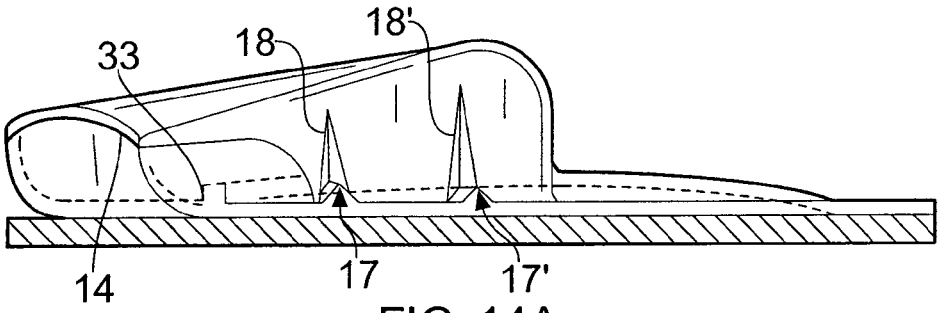
FIG. 14A is a side elevation of a first variant of the second detailed embodiment.
Figure 14B:
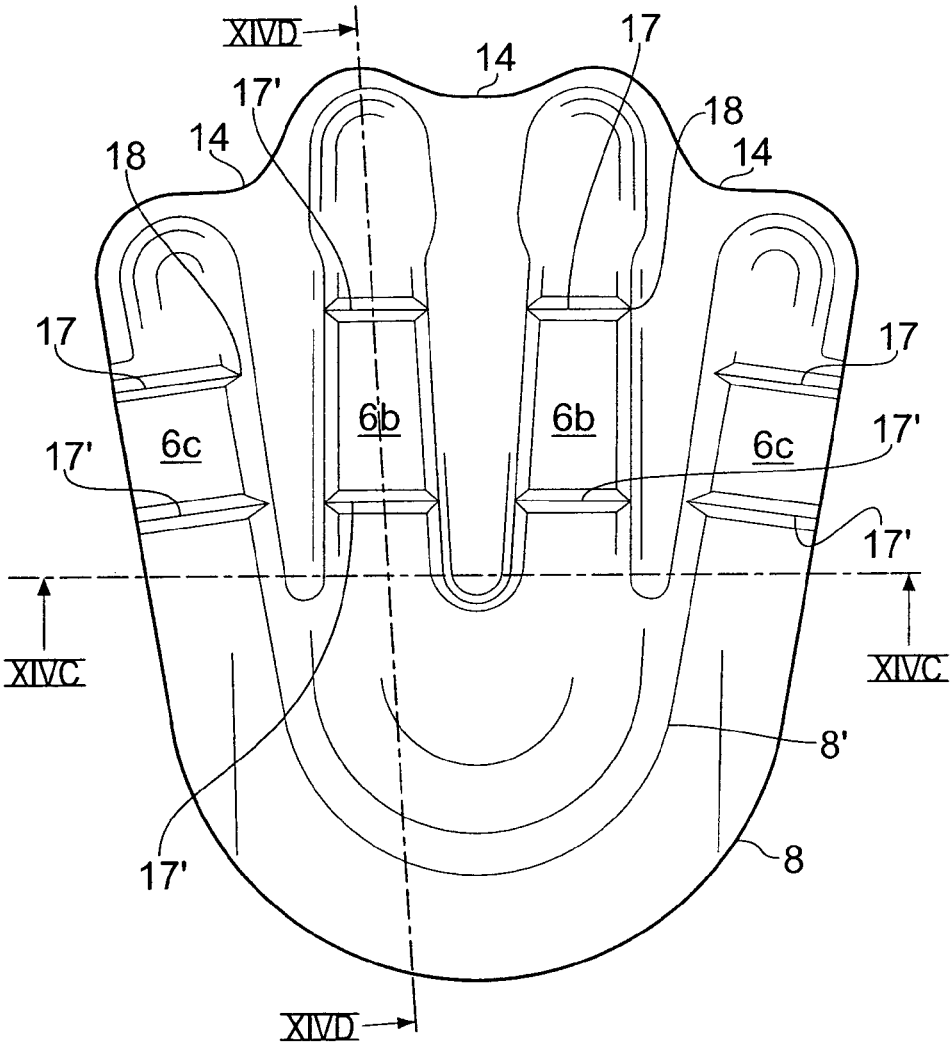
FIG. 14B is a plan view of the variant shown in FIG. 14A.
Figure 14C:
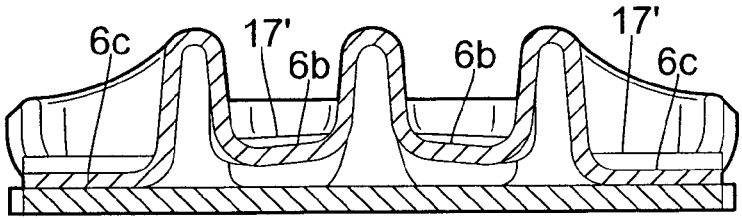
FIG. 14C is a section on the line XIVC-XIVC in 14B.

FIGS. 14A, 14B and 14C disclose a further variant of the second embodiment. In order to avoid repetition only those new aspects of the interface shown in FIGS. 13A, 13B & 13C will be described. In this embodiment the flexibility of the interface has been enhanced by the provision of sub-base inverted "V" shaped section 17 extending laterally under the base parts of each of the finger channels in the region of the positions of both finger joints. As can be seen in FIG. 13C the "V" shaped sections 17 are moulded into the base in a manner which causes them to project up into each of the finger channels. This also acts to deter the interface slipping against fingers engaged in the finger channels 2*a* and 2*b* and assist in flexure. In this variation of the second embodiment 'V' sections 18 extend vertically in the sidewalls adjacent the sub-base grooves 17. These grooves 18 taper up to a point from their position adjacent the base.

Figure 14D:
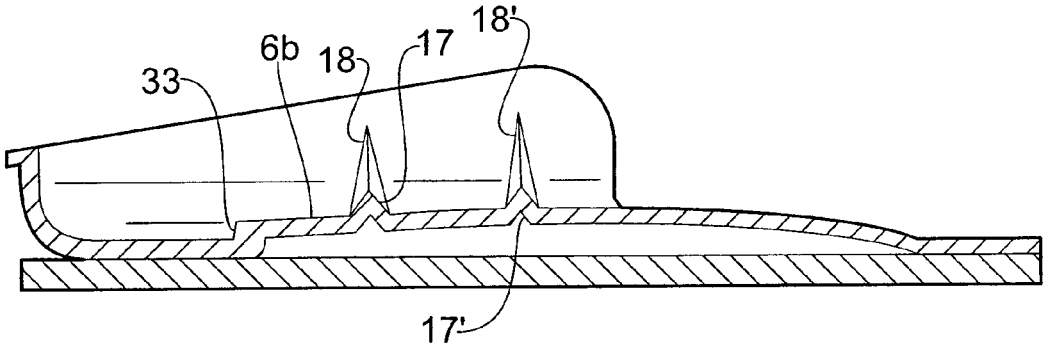
FIG. 14D is an enlarged section on XIVD-XIVD in FIG. 14B

A further feature illustrated in FIGS. 14A and 14D is a step 33 formed into the base of the fingertips of the medial channels 2*b* at the point where the domed under hand element meets the base line under the finger tips of the channels 2*b*. This acts to improve fingertip grip on the interface and further prevent it sliding forward of the hand.

Figure 15B:
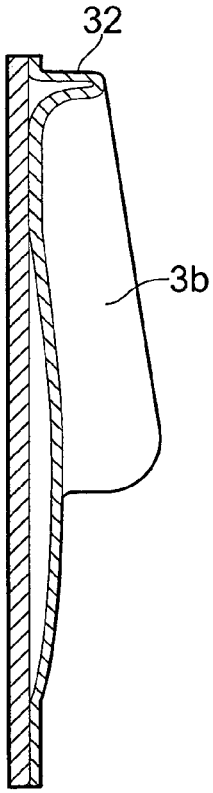
FIG. 15B is a sectional view on the line XVB-XVB in FIG. 15A.
Figure 15A:
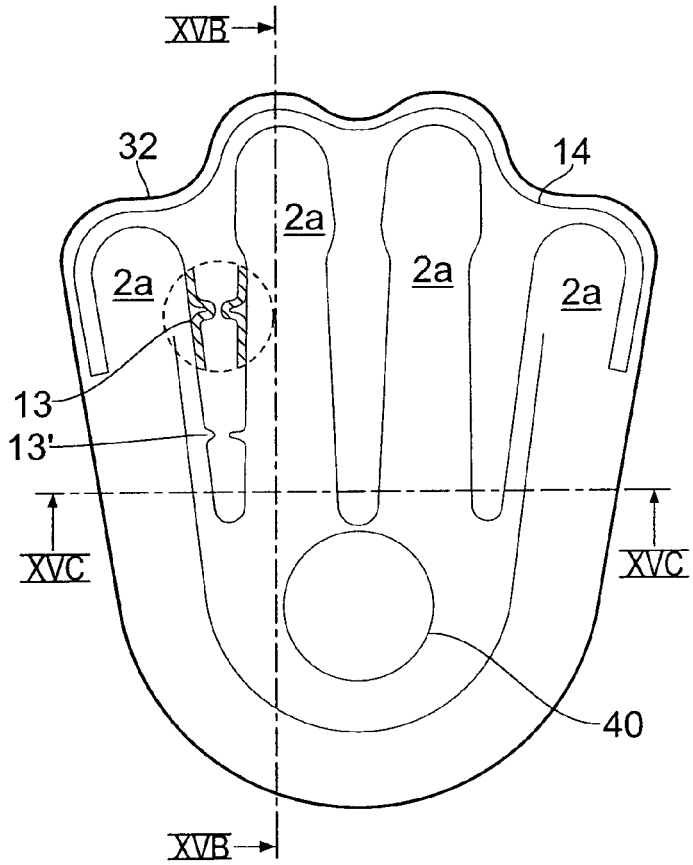
FIG. 15A is a plan view of a second variant of the second detailed embodiment.
Figure 15C:
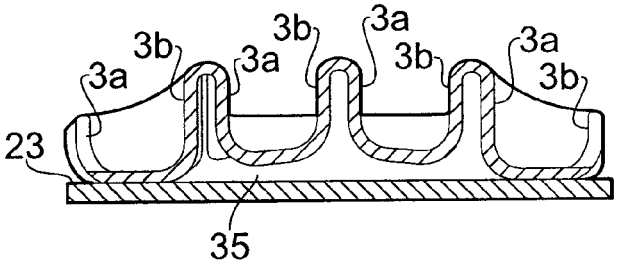
FIG. 15C is a sectional view on the line XVC-XVC.

FIGS. 15A, 15B and 15C illustrate a second variant of the second embodiment. In this second variant the protection afforded to a user by the interface one is enhanced by the development of a depending wall 32 which descends from the edge of the web 14 so following the outline of the web to the base plane. This depending wall might have apertures at the front end between the finger-tips.

The sectional view FIG. 15C illustrates a variant in which the sidewalls 3*a* and 3*b* are made relatively parallel in the direction vertical with reference to the base plane in which the media 32 lies.

Third Detailed Embodiment

FIGS. 16A, 16B, 16C & 16D show a third embodiment of the invention distinguished from the previous embodiment in that the web 14' extends forward of the channel tip walls 11*a*, 11*b* instead of following the contour of the channel tips to support a wall 18 which extends symmetrically back from a point 19 towards the tips 11*a* of the lateral finger channels 2*a*. This embodiment of the invention is envisioned to be useful in cleaning applications where it is desirable to drive a cleaning medium into corners and where additional protection of the finger-tips is desirable.

This third embodiment of the invention also exhibits the feature of a flange 18*a* extending around the leading edge and around the periphery to merge with the palm part. This flange provides an improved attachment and support structure for a cleaning or other media 23.

Figure 16A:
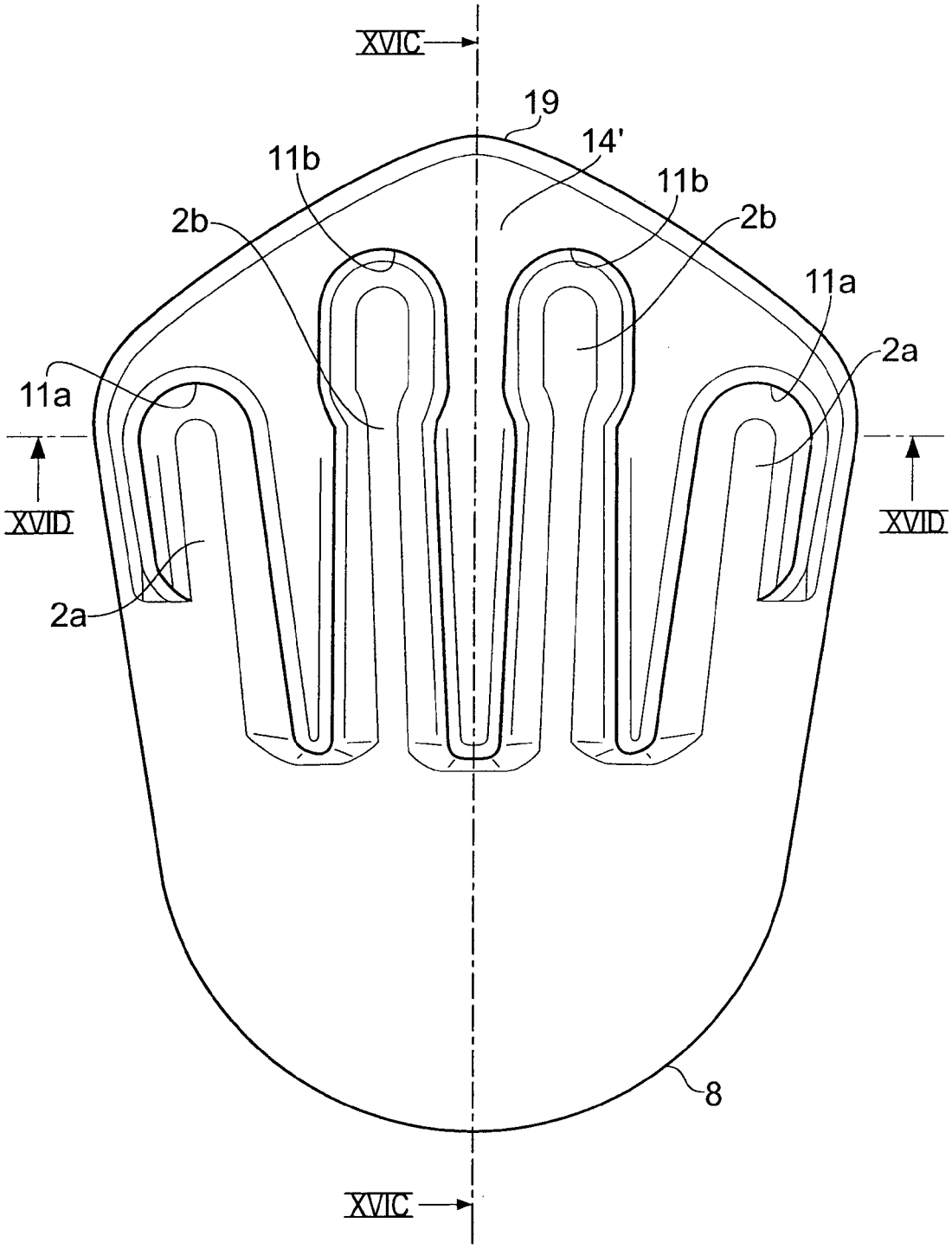
FIG. 16A shows a plan view of a third detailed embodiment of the invention.
Figure 16B:
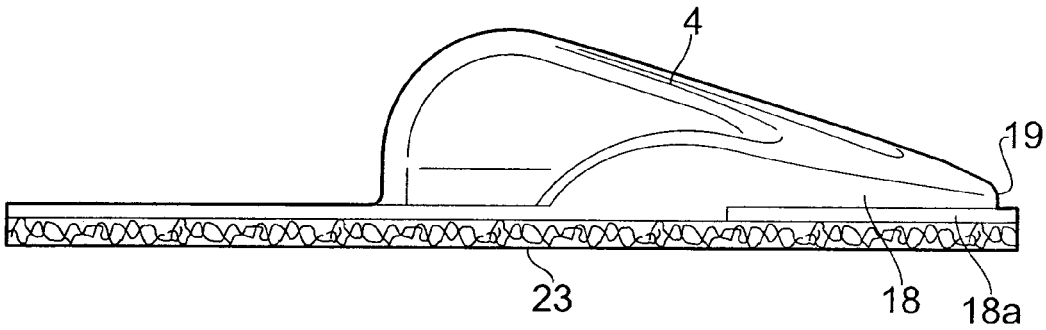
FIG. 16B shows a side elevation of the third embodiment of the invention.
Figure 16C:
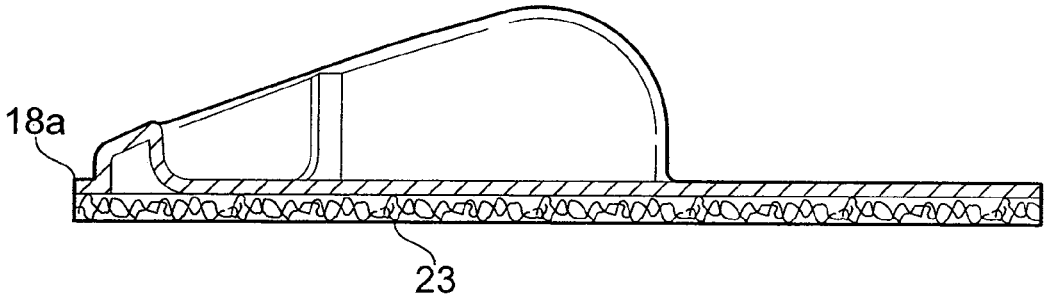
FIG. 16C shows a sectional view through the line XVIC-XVIC.
Figure 16D:
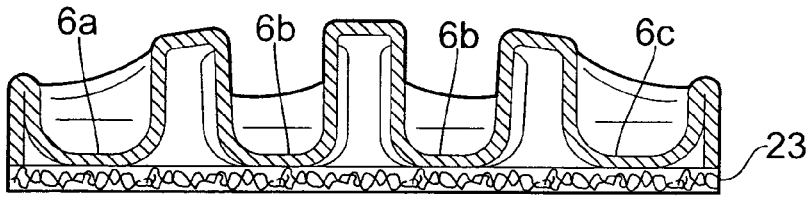
FIG. 16D shows a sectional views through the line XVID-XVID.

Attachment of a cleaning or other media may be further improved by making the base parts 6*b* and 6*c* lie in the same plane as can be seen in FIG. 16D. The media 23 can then be fastened to the underside of the base parts.

Fourth Detailed Embodiment

Figure 17A:
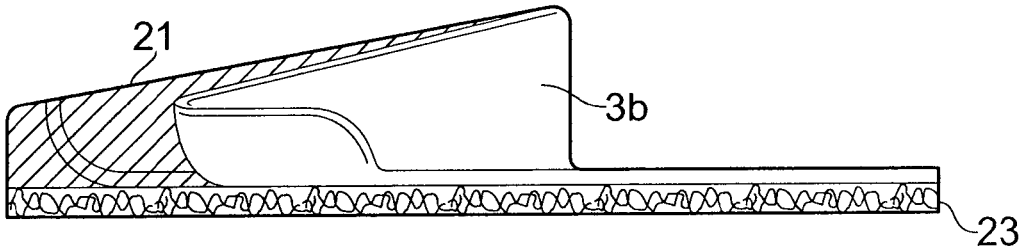
FIG. 17A a shows a side elevation of a fourth detailed embodiment of the interface.
Figure 17B:
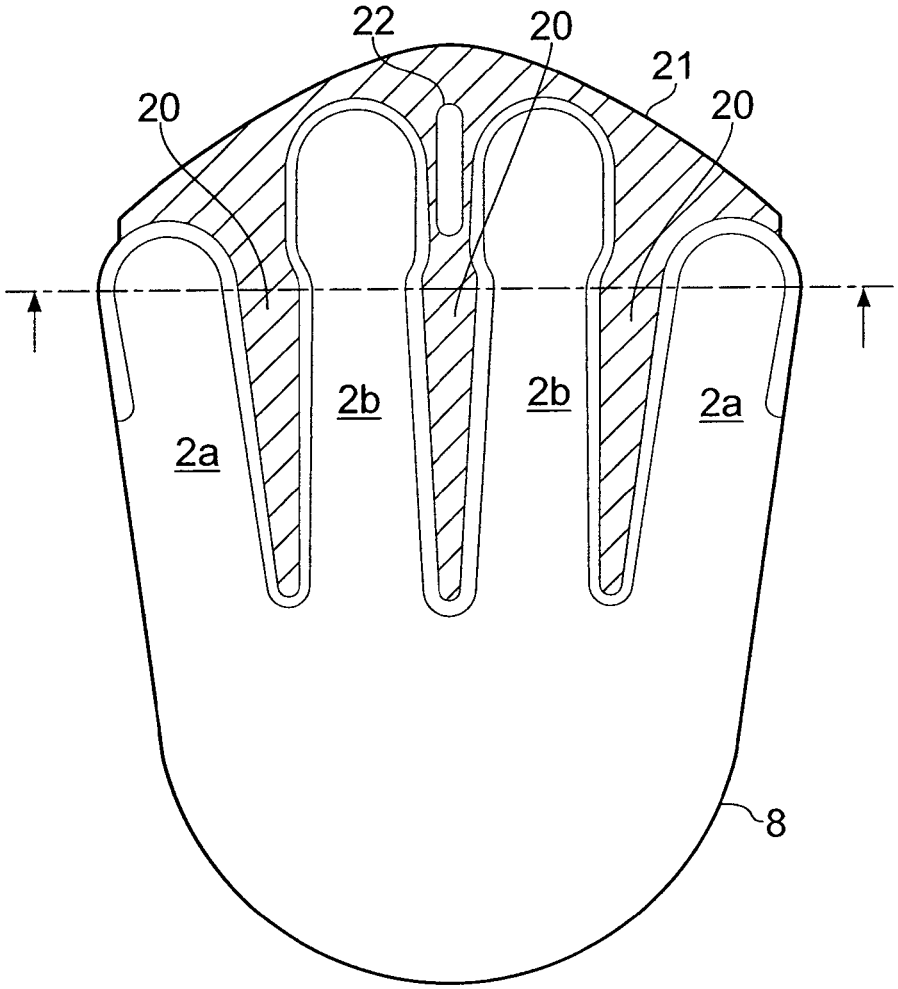
FIG. 17B shows a plan view of the fourth detailed embodiment of the interface.
Figure 17C:
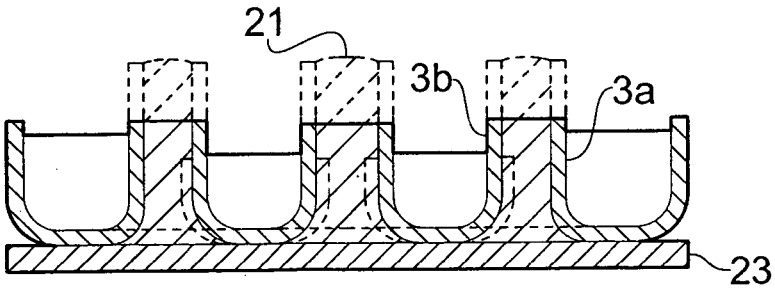
FIG. 17C shows a sectional view on the line XI-XI.

FIGS. 17A, 17B and 17C illustrate a fourth embodiment of the hand utility interface this differs from the previous embodiments in that the palm part 8 and finger channels 2*a*, 2*b* are initially formed from a self-supporting membrane, however the resilience required to urge the sidewalls of the finger channels into engagement with the fingers is provided by packing the spaces 20 intervening between opposing sidewalls 3*a*, 3*b* of adjacent finger channels with a resilient medium.

This fourth embodiment may provide the resilient medium by means of a sack 21 containing a cleaning material, preferably in the form of a gel. The gel sack 21 may extend into the spaces 20 and may be welded in place. Preferably the gel sack 21 is transparent to allow inspection of the volume of material remaining inside. A press button 22 may be actuated to discharge a volume of gel into a cleaning medium 23 attached to the underside of the hand utility interface. So that the gel sack does not collapse as its content is discharged, each press of the button 22 causes a corresponding volume of air to be pumped into the gel sack.

Fifth Detailed Embodiment

Figure 18A:
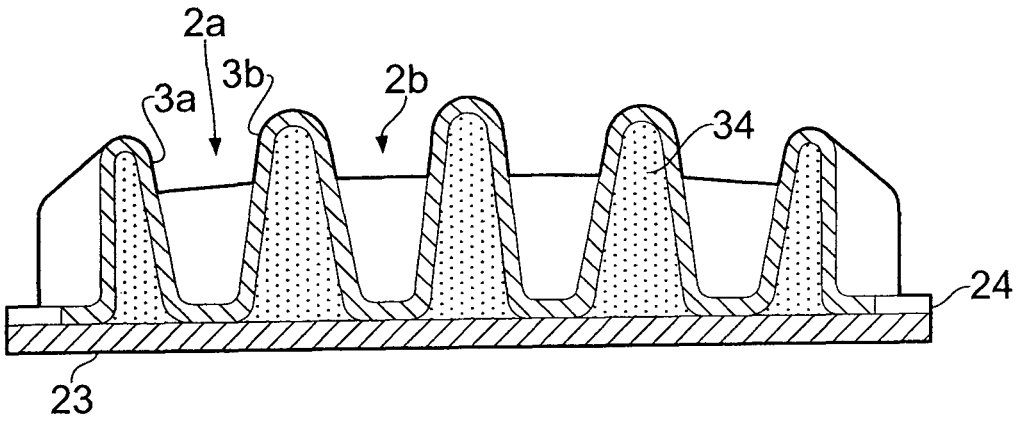
FIG. 18A shows a sectional view of a fifth detailed embodiment of the invention.

FIG. 18A illustrates a fifth embodiment of the hand utility interface showing a first variant in which the spaces between the sidewalls 3 are each packed with a resilient material. In this particular example the packing material is a gel 34 contained within a flexible pack which may be welded in place. Alternatively a membrane y be welded to the base of the interface so that together they form a sealed cavity. When squeezed together the flowable gel material may be discharged into the cleaning media. The gel may provide resilience to the finger channel walls 2*a*, 2*b*. In an alternative example a set foam may substitute for the gel to increase the resilience of the sidewalls. In FIG. 18A the cleaning media 23, such as a sponge, scourer, buff or cloth is permanently bonded to a flange 24 extending around the periphery of the interface 1.

Figure 18B:
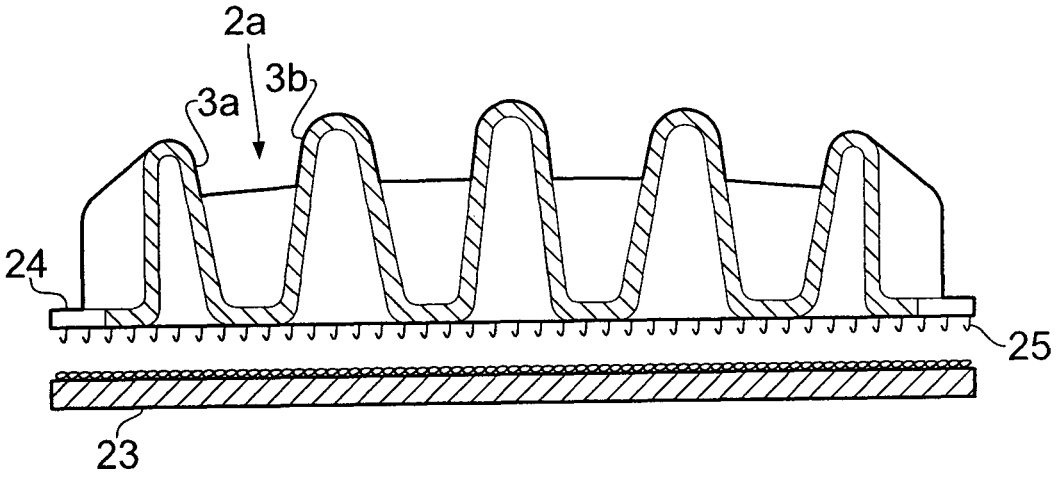
FIG. 18B shows a sectional view of a variant of the fifth detailed embodiment.
Figure 18C:
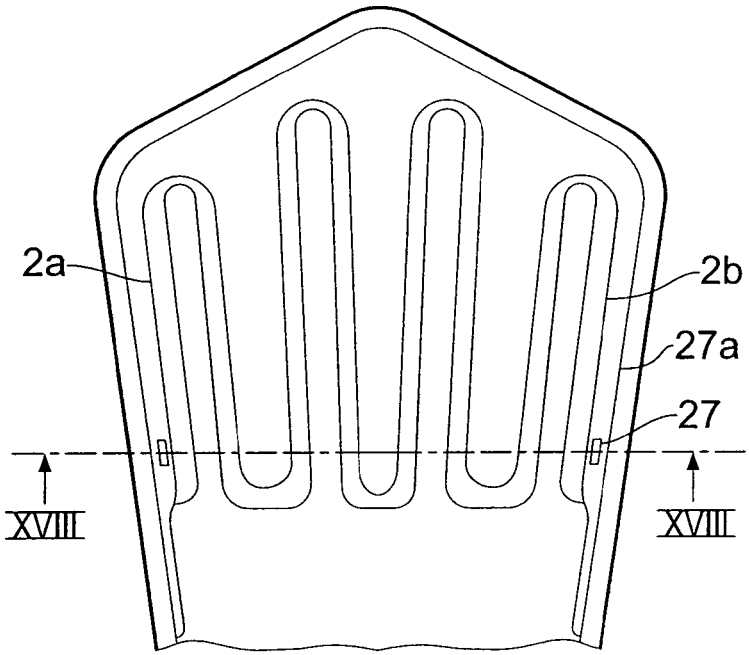
FIG. 18C shows a plan view of a second variant of the fifth detailed embodiment.

FIG. 18B is a second variant of the fifth embodiment in which a cleaning or abrasive media 23 is separably attached to the flange 24 by means of a fabric hook and eye fastening 25.

In a fourth variant of this embodiment (not illustrated) hook fabric fasteners are disposed on the sides of the interface. The media to be attached via these fasteners are wet and other wipes in a special package whereby the interface is pressed down into the package which then engages the topmost one of the media at the edges and which therefore comes away with the interface as it is lifted up.

FIGS. 18C to 18F show a further variant of the fifth embodiment. In this variant the spaces 20 beneath the self-supporting membrane contain a gel sack 21. The interface resembles the interface in the first or second embodiments in that a space 35 is provided beneath the palm part and the finger channels 2*a*, 2*b* into which the gel sack 21 extends. The gel sack 21 is tailored so that projecting portions 38 project up into the spaces 20 leaving a gap 39 between the walls 3*a*, 3*b*. Discharge of the gel sack 21 is controlled by a valve assembly consisting of an elongate resilient beam 26 with a medial portion secured by welds 37 to a relatively rigid member 27. The relatively rigid member 27 is bonded into a sealing membrane 27*a* which in turn seals the underside of the gel pack 21. The resilient beam 26 supports depending conical plugs 36 which extend down to engage in corresponding conical apertures 36*a*. Upright levers 29 extend from the ends of the beam 26 to engage within the spaces 20 enveloped by the lateral sidewalls. At rest the beam 26 is biased to urge the plugs 36 to close the apertures 28 so that the gel in the gel sack 21 cannot pass into the medium 23. In order for a charge of the gel to be discharged into the medium 23, the lateral sidewalls are squeezed inwardly by either thumb thus opening the apertures 28 by lifting the pegs 36 from the apertures 36*a* and simultaneously compressing the gel sack 21 to encourage the passage of gel through the apertures. To further enhance the ergonomics of this variant the outermost sidewalls, 2*a*,2*b* which are short in most embodiments, are extended to reach the region of location of the carpophalangeal joints. The valve assembly is mounted as shown to underlie the region of the carpophalangeal joints. This allows the interface to flex about the joint with minimal interference from the valve assembly and simultaneously permits the valve assembly to be actuated by the thumb of a user pressing against the outside of the wall part.

Figure 18D:
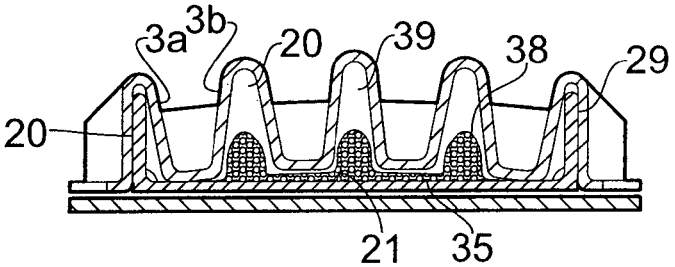
FIG. 18D is a sectional view on the line XII-XII of the fifth detailed embodiment detailing a valve to control the discharge of flowable material.
Figure 18E:
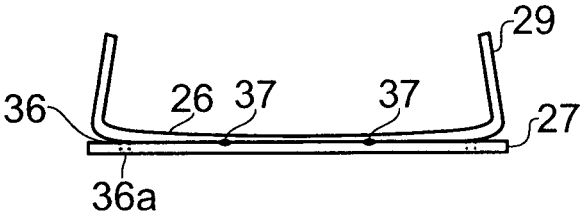
FIG. 18E is a detail of the value in FIG. 12D.
Figure 18F:
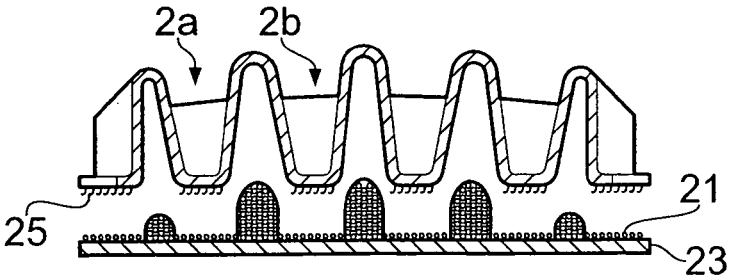
FIG. 18F is a section through a third variant of the fifth detailed embodiment.

The cleaning media 23 shown in FIG. 18D is permanently bonded to the interface 1 making the gel sack irreplaceable, however the variant shown in FIG. 18F shows a gel sack 21 and cleaning media 23 secured to the interface 1 by hook and eye fabric fastening means 25 whereby both the gel sack and media may be replaced.

As may be seen in FIGS. 11B and 15A a transparent inspection window 40 may be provided through the palm to further enhance the utility of this variant by allowing a user to estimate the quantity of gel charge remaining in the sack.

Figure 19A:
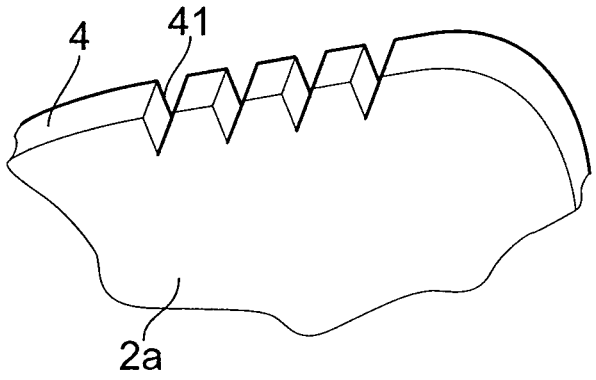
FIGS. 19A to 19C show partial perspective views of variants of the wall and bridge structure.
Figure 19B:
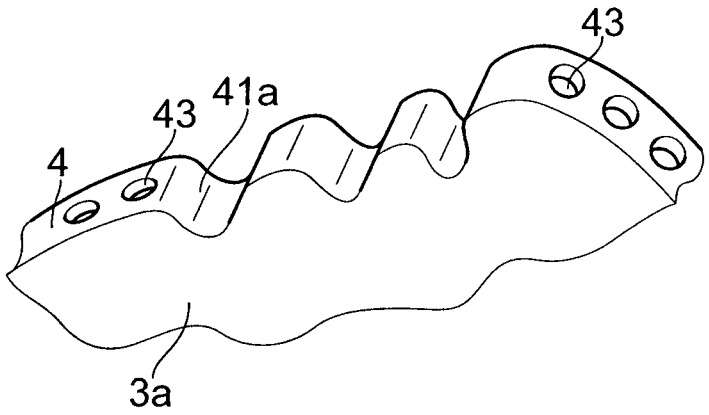
Figure 19C:
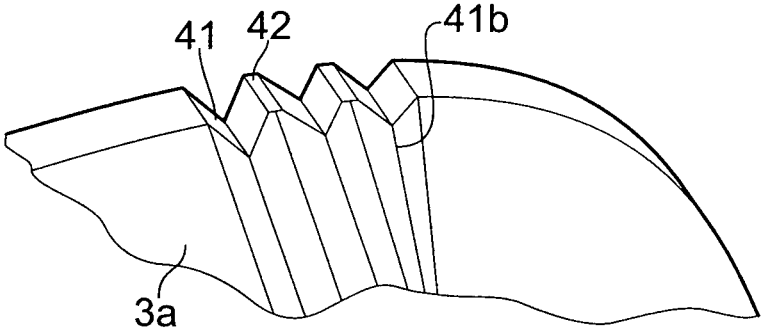

FIGS. 19A to 19C show perspective views of variants of the wall and bridge structure which may be introduced to any of the embodiments in order to enhance their flexibility and general performance. Each view is of a portion of the bridge structure in the region where the side walls of adjacent finger channels 2*a*, 2*b* meet. To enhance flexibility the variant of FIG. 19A exhibits a plurality of parallel adjacent "V" section relief channels 41 extending laterally across the bridge 4. In the second variant of FIG. 19B the laterally extending relief channels 41*a* are of "U" section. In the third variant of FIG. 19C the "V" section relief channels are separated at the top at least by flats 42. Further flexibility is provided by continuing the "V" section relief channels at 41*b* down the side walls 2*a*, 2*b*.

FIG. 19B illustrates the provision of holes 43 in the bridge 4 which reduce weight and increase flexibility.

FIGS. 10A, 10B and 10C disclose a further feature of the interface in which resilient "U" section structures 44 extend laterally across the underlying base panels 6*a*, 6*b* of the finger channels 2*a*, 2*b*. These "U" section base features cooperate with adjoining adjacent "U" section features 45, 45' rising up the side walls 2*a*, 2*b*. These features collapse readily when the fingers of a gripped hand are flexed.

The interface has been described above as a means to engage a hand with another media, utility or working device for a very large possible range of purposes, including at least: baby care, beauty care, patient care, grooming of either people or animals, domestic surface care, wet trade and food surface care, hospital surface care, janitorial care, automotive care, boat care, DIY abrasives, automotive repair abrasives. However, the interface 1 may serve a useful purpose independently of any other attachment or apparatus, for example it may be produced having a very high degree of stiction in its bottom surface and as such employed to assist a user in gripping for the purpose of removing a lid from a jar for example. It is capable of serving many of the protective functions performed by a conventional glove. It may be possible to incorporate cleaning, disinfecting or other compositions into the membrane. Abrasives may be incorporated into the membrane.

A further advantage of the interface is the facility with which it can be crushed beyond its elastic limit in order to compact it for disposal.

The embodiments of a hand utility interface described and illustrated all present four finger channels; however, embodiments provided with only three or two finger channels are within the scope of this application and can readily be contrived by the skilled person from the description above.

It should also be noted that the hand utility interface may be picked up or engaged by the back of the fingers making it particularly useful for cleaning for example the inside of a car windscreen.

In preferred embodiments the hand utility interface finger channels each have a channel tip where the tip of a user's finger is to be accommodated, and wherein a portion of each finger channel lying distal of a position where a distal interphalangeal joint of a finger will be received is of increased width, relative to a width of an adjoining proximal part of the finger channel, to alleviate pinching of a user's finger tip during use.

The invention claimed is:

1. A hand utility interface comprising at least two finger channels, each finger channel having side walls and an open top and being sized and shaped to receive one finger of a user's hand, the finger channels acting to releasably grip the hand utility interface to the user's hand when fingers of the user's hand are pressed through the open tops of the at least two finger channels, wherein the hand utility interface is fabricated from a self-supporting resilient membrane that is a thin sheet that is molded so that a first part of the thin sheet defines a first thin side wall of a first said finger channel, a second part of the thin sheet defines an opposing thin side wall of the first said finger channel, a third part of the thin sheet defines a first thin side wall of a second said finger channel, a fourth part of the thin sheet defines an opposing thin side wall of the second said finger channel and a further part of the sheet forms a bridge part that bridges between the first said finger channel and the second said finger channel at a height between a side wall of the first finger channel and a side wall of the second finger channel.

2. A hand utility interface according to claim 1 wherein each finger channel has opposing side parts elastically deformable by the ingress of a finger of a user's hand to resiliently grip at least a part of the finger.

3. A hand utility interface according to claim 1 wherein the interface is sufficiently resilient to substantially recover its shape after being crushed and released by a user's hand.

4. A hand utility interface according to claim 1 wherein the thickness of the membrane is in a range of from about 5 mm to about 0.5 mm.

5. A hand utility interface according to claim 1 wherein each finger channel comprises at least one upstanding wall part, and a discontinuity is formed to extend through the at least one upstanding wall part in order to increase the flexibility of the hand utility interface in the region of the discontinuity.

6. A hand utility interface according to claim 1 wherein the hand utility interface includes a palm part and each finger channel includes a channel tip, wherein at least a base of at least one finger channel forms an arc rising and extending from the channel tip towards the palm part.

7. A hand utility interface according to claim 6 wherein a palm engaging part of the hand utility interface continues the arc.

8. A hand utility interface according to claim 1 fabricated entirely from a unitary sheet of membrane.

9. A hand utility interface according to claim 1 wherein the membrane comprises a thermo-formable foam.

10. A hand utility interface according to claim 1 wherein each finger channel comprises channel walls and a channel tip, the channel walls extend around the channel tip of each finger channel where the tip of a user' s finger is to be accommodated, and wherein a portion of each finger channel lying distal of a position where a distal interphalangeal joint of a finger will be received is of increased width, relative to a width of an adjoining proximal part of the finger channel, to alleviate pinching a user's finger tip during use.

11. A hand utility interface according to claim 1 wherein each finger channel has a channel tip and associated channel walls, and a web of the membrane extends between the channel tip of each finger channel from an uppermost edge of the channel walls.

12. A hand utility interface according to claim 11 wherein the web extends distal of the channel tip of each finger channel and supports a descending outer wall.

13. A hand utility interface according to claim 11 wherein the descending outer wall converges to a point.

14. A hand utility interface according to claim 1, comprising an outermost side wall and an outermost periphery, wherein the outermost sidewall joins on to a flange extending at least part way around the outermost periphery of the hand utility interface for engagement of the hand utility interface with a utility device.

15. A hand utility interface according to claim 1 wherein each finger channel has a channel tip, and at least a base part of each finger channel remote from the channel tip joins to a palm supporting part.

16. A hand utility interface according to claim 1 in combination with a utility device, wherein the utility device is engaged by a medium attached to an underside of the hand utility interface.

17. A hand utility interface according to claim 16 wherein the medium is replaceably attached to the hand utility interface.

18. A hand utility interface according to claim 1 wherein a charge of a paste, gel, or liquid is stored in a cavity formed between the hand utility interface and a cleaning medium.

* * * * *